US007281605B2

(12) United States Patent
Huff et al.

(10) Patent No.: US 7,281,605 B2
(45) Date of Patent: Oct. 16, 2007

(54) MUFFLERS WITH ENHANCED ACOUSTIC PERFORMANCE AT LOW AND MODERATE FREQUENCIES

(75) Inventors: Norman T. Huff, Brighton, MI (US); Larry J. Champney, Horton, MI (US); Ahmet Selamet, Dublin, OH (US); Iljae Lee, Columbus, OH (US)

(73) Assignees: Owens-Corning Fiberglas Technology II, LLC, Toledo, OH (US); The Ohio State University Research Foundation, Columbus, OH (US)

( * ) Notice: Subject to any disclaimer, the term of this patent is extended or adjusted under 35 U.S.C. 154(b) by 411 days.

(21) Appl. No.: 10/836,777

(22) Filed: Apr. 30, 2004

(65) Prior Publication Data

US 2004/0262077 A1 Dec. 30, 2004

Related U.S. Application Data

(60) Provisional application No. 60/467,468, filed on May 2, 2003.

(51) Int. Cl.

| | |
|---|---|
| ***F01N 1/02*** | (2006.01) |
| ***F01N 1/24*** | (2006.01) |
| *F01N 1/04* | (2006.01) |
| *F01N 1/08* | (2006.01) |

(52) U.S. Cl. ..... 181/250; 181/252; 181/256; 181/266; 181/273; 181/276

(58) Field of Classification Search ..... 181/250, 181/249, 252, 255, 256, 266, 269, 273, 276
See application file for complete search history.

(56) References Cited

U.S. PATENT DOCUMENTS 1,878,424 A * 9/1932 Oldberg ..... 181/250
2,014,666 A * 9/1935 Peik ..... 181/252
2,051,515 A * 8/1936 Bourne ..... 181/252
2,059,487 A * 11/1936 Peik ..... 181/252
2,075,263 A * 3/1937 Bourne ..... 181/256
2,139,151 A * 12/1938 Deremer ..... 181/250
2,166,408 A * 7/1939 Hoyle ..... 181/266

(Continued)

FOREIGN PATENT DOCUMENTS

DE 10132164 1/2002

(Continued)

OTHER PUBLICATIONS

Radavich et al, "A computational approach for flow-acoustic coupling in closed side branches".

(Continued)

*Primary Examiner*—Edgardo San Martin
(74) *Attorney, Agent, or Firm*—Inger H. Eckert; Margaret S. Milliken

(57) ABSTRACT

The invention relates to an exhaust silencer or muffler for an internal combustion engine, in particular a silencer with the damping characteristics of a resonator with the absorptive characteristics of a dissipative silencer. The silencer of the present invention provides an improved silencer or muffler for use with an internal combustion engine that incorporates both a dissipative silencer and a resonator in a single muffler assembly suitable for use with standard automotive construction techniques.

43 Claims, 16 Drawing Sheets

U.S. PATENT DOCUMENTS

| | | | | | |
|---|---|---|---|---|---|
| 2,326,612 | A | * | 8/1943 | Bourne | 181/252 |
| 2,501,306 | A | * | 3/1950 | Bessiere | 181/252 |
| 2,523,260 | A | | 9/1950 | Campbell | |
| 2,937,707 | A | * | 5/1960 | Ernst | 181/252 |
| 3,180,712 | A | * | 4/1965 | Hamblin | 422/171 |
| 3,434,565 | A | * | 3/1969 | Fischer | 181/250 |
| 3,710,891 | A | | 1/1973 | Flugger | |
| 3,738,448 | A | | 6/1973 | Ver et al. | |
| 3,754,619 | A | * | 8/1973 | McCormick | 181/248 |
| 4,046,219 | A | | 9/1977 | Shaikh | |
| 4,278,147 | A | * | 7/1981 | Watanabe et al. | 181/256 |
| 4,342,373 | A | * | 8/1982 | Erickson et al. | 181/266 |
| 4,501,341 | A | * | 2/1985 | Jones | 181/250 |
| 4,513,841 | A | | 4/1985 | Shimoji et al. | |
| 4,523,662 | A | | 6/1985 | Tanaka et al. | |
| 4,569,471 | A | * | 2/1986 | Ingemansson et al. | 228/176 |
| 4,700,805 | A | * | 10/1987 | Tanaka et al. | 181/265 |
| 4,834,214 | A | | 5/1989 | Feuling | |
| 4,841,728 | A | * | 6/1989 | Jean et al. | 60/312 |
| 4,846,302 | A | * | 7/1989 | Hetherington | 181/243 |
| 5,198,625 | A | | 3/1993 | Borla | |
| 5,350,888 | A | | 9/1994 | Sager, Jr. et al. | |
| 5,365,025 | A | | 11/1994 | Kraai et al. | |
| 5,602,368 | A | * | 2/1997 | Kaneso | 181/255 |
| 5,659,158 | A | | 8/1997 | Browning et al. | |
| 5,766,541 | A | * | 6/1998 | Knutsson et al. | 264/571 |
| 5,773,770 | A | | 6/1998 | Jones | |
| 5,783,780 | A | | 7/1998 | Watanabe et al. | |
| 5,783,782 | A | | 7/1998 | Sterrett et al. | |
| 5,976,453 | A | * | 11/1999 | Nilsson et al. | 264/555 |
| 6,068,082 | A | * | 5/2000 | D'Amico et al. | 181/256 |
| 6,089,348 | A | * | 7/2000 | Bokor | 181/272 |
| 6,354,398 | B1 | | 3/2002 | Angelo et al. | |
| 6,386,317 | B1 | | 5/2002 | Morohoshi et al. | |
| 6,412,596 | B1 | * | 7/2002 | Brandt et al. | 181/256 |
| 6,415,888 | B2 | | 7/2002 | An et al. | |
| 6,446,750 | B1 | * | 9/2002 | Lewin | 181/256 |
| 6,581,723 | B2 | * | 6/2003 | Brandt et al. | 181/256 |
| 6,607,052 | B2 | * | 8/2003 | Brandt et al. | 181/256 |
| 6,668,972 | B2 | * | 12/2003 | Huff et al. | 181/256 |
| 2001/0015301 | A1 | | 8/2001 | Kesselring | |
| 2002/0121404 | A1 | | 9/2002 | Storm | |
| 2002/0144860 | A1 | | 10/2002 | Galaitsis | |

FOREIGN PATENT DOCUMENTS

| | | | | |
|---|---|---|---|---|
| EP | 589516 | A2 | * | 3/1994 |
| GB | 403651 | | | 12/1938 |
| JP | 56014820 | | | 2/1981 |
| JP | 59041618 | A | * | 3/1984 |
| JP | 01190912 | | | 8/1989 |
| JP | 02112608 | | | 4/1990 |
| JP | 05232967 | A | * | 9/1993 |
| JP | 05240120 | A | * | 9/1993 |
| JP | 06280542 | A | * | 10/1994 |
| JP | 10252442 | | | 9/1998 |

OTHER PUBLICATIONS

Boonen et al. "Design of an active exhaust attenuating valve for internal combustion engines."

Mechanical Engineering—Engineer on Disk—1.10 Mufflers.

Mechanical Engineering—Engineer on Disk—1.10.3 Plenum.

Mechanical Engineering—Engineer on Disk—1.10.4. Expansion Chamber.

Mechanical Engineering—Engineer on Disk—1.10.5 Cavity Resonator (Helmholtz).

Soh et al.—"Industrial Resonator Muffler Design".

Birdsong et al.—"A Smart Helmholtz Resonator".

Haleem—The Hindu—"How does an exhaust silencer work?"

* cited by examiner

MUFFLERS WITH ENHANCED ACOUSTIC PERFORMANCE AT LOW AND MODERATE FREQUENCIES

BACKGROUND OF THE INVENTION

Typical absorption type silencers or mufflers 10 shown in FIG. 1 (also known as dissipative silencers) include outer shell 12, and a porous pipe 14 connecting entry and exit pipes 14A and 14B for fluid communication of exhaust from an internal combustion engine. Sound absorbing material 18 is filled between the porous pipe 14 and the inner surface of the muffler chamber. Absorption silencers efficiently reduce acoustical energy in intermediate and high frequencies (typically above 200 Hz) by the sound absorbing characteristics of the sound absorbing material 18. The "broad band" absorption of acoustic energy is desired in automotive exhaust applications because the frequency of the acoustic energy produced by the engine will vary as the engine speed (RPM) changes and as the exhaust gas temperatures vary.

Another type of silencer is what is typically called a reflective silencer. In reflective silencers, elements are designed to reflect or generate sound waves that destructively interfere with sound waves emanating from the engine. One type of acoustic reflective element is commonly known as a Helmholtz resonator. A Helmholtz resonator is a chamber with an open throat. A volume of air located in the chamber and throat vibrates because of periodic compression of the air in the chamber. Helmholtz resonators may be attached to exhaust pipes of internal combustion engines as is shown in FIG. 3 to cancel noise caused by the firing of the pistons of the internal combustion engine (typically 30 to 400 Hz). FIG. 3 schematically illustrates a muffler 50 which includes a rigid outer shell 52, a Helmholtz resonator 54 which includes a throat portion 54*a* having an inner diameter $D_T$, and a length $L_T$, and a chamber portion 54*b* having an inner diameter $D_C$, and a length $L_C$.

Typically, the peak attenuation frequency of sound energy, i.e., the frequency at which the greatest transmission loss occurs, is a function of the volume of the chamber portion 54*b* of the Helmholtz resonator 54 and the throat portion inner diameter $D_T$ and length $L_T$. For example, if the chamber volume increases and the throat portion inner diameter $D_T$, and length $L_T$ remain the same, the peak attenuation frequency decreases, and if the chamber volume decreases, the peak attenuation frequency increases.

When the Helmholtz resonator 54 is attached as a side branch, as shown in FIG. 3, the side branch has both mass (inertia) and compliance. This acoustic system is called a Helmholtz resonator and behaves very much like a simple mass-spring damping system. The resonator has a throat with diameter $D_T$ and area $S_b$, an effective neck length of $L_{eff}=L+0.85D_T$, and a cavity volume V (a function of $D_C$ and $L_C$). The cavity volume resonates at a frequency, and in the process of resonating, it interacts with energy. All of the energy absorbed by the resonator during one part of the acoustic cycle is returned to the pipe later in the cycle. The phase relationship is such that the energy is returned back towards the source—it does not get sent on down the duct. Since no energy is removed from the system, the real part of the branch impedance $R_b=0$. The imaginary part of the impedance may be expressed in terms of the compliance and inertia of the resonator, $X_b=p(w\ L_{eff}/S_b-c^2/wV)$, so that the equation of the sound power transmission coefficient may be written as shown in equation (1).

$$T_{\Pi}=\left[1+\left(\frac{c^2}{4S^2(\omega L_{eff}/S_b-c^2/\omega V)^2}\right)\right]^{-1} \quad (1)$$

The transmitted power is zero when $w=w_0$ in Eq. (1), which is the resonance frequency of the resonator, at which all of the energy is reflected back towards the source. These filters decrease sound within a band around the resonance frequency, and pass all other frequencies. The narrow frequency range over which interference occurs is normally not a desired condition in an automobile exhaust since the frequency of the acoustic energy will vary as the engine speed (RPM) varies and as the temperature of the exhaust gases vary.

BRIEF SUMMARY OF THE INVENTION

The invention relates to an exhaust silencer or muffler for an internal combustion engine, in particular, a silencer, with the damping characteristics of a Helmholtz resonator and the absorptive characteristics of a dissipative silencer for an internal combustion engine. It is an object of the present invention to provide an improved silencer or muffler for use with an internal combustion engine that incorporates one or more both a dissipative silencer elements and one or more reflective elements such as a Helmholtz resonator. It is another object of the invention to provide improved dissipative element and resonators for use in such a muffler It is a further object of the invention to provide a combined dissipative silencer and resonator in a single muffler assembly suitable for use with standard automotive construction techniques which has superior performance compared to prior art.

DETAILED DESCRIPTION AND PREFERRED EMBODIMENTS OF THE INVENTION

Figure 1:
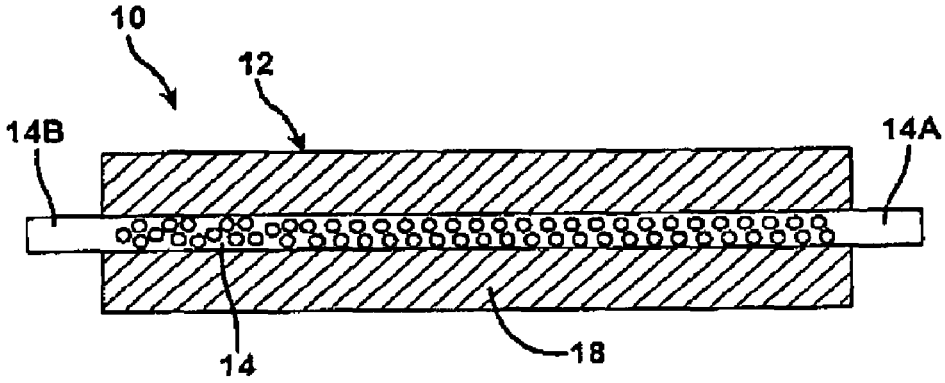
FIG. 1 PRIOR ART
FIG. 1 is a plan view of a prior art absorptive muffler.
Figure 1A:
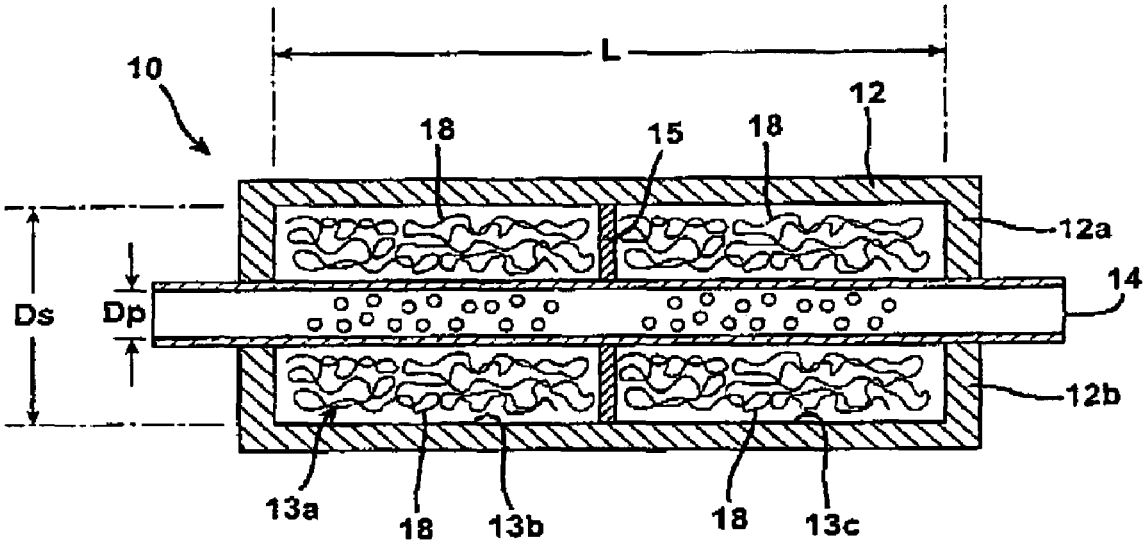
FIG. 1A is a plan view of an absorptive muffler including an interior baffle.

The muffler 10 of FIG. 1A includes a rigid outer shell 12 defined by first and second shell parts 12*a* and 12*b*. The shell parts 12*a* and 12*b* are formed from a metal, a resin, or a composite material formed of, for example, reinforcement fibers and a resin material. Examples of suitable outer shell composite materials are set forth in formerly co-pending U.S. patent application Ser. No. 09/992,254, now U.S. Pat. No. 6,668,972, entitled Bumper/Muffler Assembly, the disclosure of which is incorporated herein by reference in its entirety (the '972 patent). It is also contemplated that the outer shell may alternatively include a single shell part or two or more shell parts. Extending through the outer shell 12 is a perforated metal pipe 14 formed, for example, from a stainless steel. Also provided in the inner chamber 13*a* of the outer shell is a baffle 15 or partition, made from steel, another metal, a resin, or a composite material, such as one of the outer shell composite materials disclosed the '972 patent. The baffle 15 separates the inner chamber 13*a* into first and second substantially equal-size inner chambers 13*b* and 13*c*. It is also contemplated that the baffle 15 may separate the inner chamber 13*a* into first and second chambers having unequal sizes.

Provided within the outer shell 12 and positioned between the pipe 14 and the shell 12 is a fibrous material 18. The fibrous material 18 substantially fills both the first and second chambers 13*b* and 13*c*. The fibrous material 18 may be formed from one or more continuous glass filament strands, wherein each strand comprises a plurality of filaments which are separated or texturized via pressurized air so as to form a loose wool-type product in the outer shell 12, see, e.g., U.S. Pat. Nos. 5,976,453 and 4,569,471, the disclosures of which are incorporated herein by reference in their entireties. The filaments may be formed from continuous glass strands, such as, for example, E-glass, S2-glass, or other glass compositions. The continuous strand material may comprise an E-glass roving such as a low boron, low fluorine, high temperature glass sold by Owens Corning under the trademark ADVANTEX® or an S2-glass roving sold by Owens Corning under the trademark ZenTron®.

It is also contemplated that a ceramic fiber material may be used instead of a glass fibrous material to fill the outer shell 12. Ceramic fibers may used to fill directly into the shell or used to form a muffler preform, which is subsequently placed in the shell 12. It is also contemplated that preforms may be made from a discontinuous glass fiber product produced via a rock wool process or a spinner process, such as one of the spinner processes used to make fiber glass thermal insulation for residential and commercial applications, or from glass mat products.

It is additionally contemplated that continuous glass strands can be texturized and formed into one or more preforms, which may then be placed in the shell parts 12*a* or 12*b* prior to coupling the shell parts 12*a* and 12*b* to form the preform. Processes and apparatus for forming such preforms are disclosed in U.S. Pat. Nos. 5,766,541 and 5,976,453, the disclosures of which are incorporated herein by reference in their entireties. Fibrous material 18 may contain loose discontinuous glass fibers, e.g., E glass fibers, or ceramic fibers which are manually or mechanically inserted into the shell 12.

It is also contemplated that the fibrous material 18 may be filled into bags made from plastic sheets or glass or organic material mesh and subsequently placed into the shell parts 12*a* and 12*b*, see, e.g., U.S. Pat. No. 6,068,082, and formerly co-pending application, U.S. patent application Ser. No. 09/952,004, now U.S. Pat. No. 6,607,052, the disclosures of which are incorporated herein by reference in their entireties. It is additionally contemplated that the fibrous material 18 may be inserted into the outer shell 12 via any one of the processes disclosed in: U.S. Pat. Nos. 6,446,750; 6,412,596; and 6,581,723 the disclosures of which are incorporated herein by reference in their entireties.

It is further contemplated that the one or more continuous glass filament strands may be fed into openings (not shown) in the outer shell 12 after the shell parts 12*a* and 12*b* have been coupled together along with pressurized air such that the fibers separate from one another and expand within the outer shell 12 and form a "fluffed-up" or wool-type product within the outer shell 12. Processes and apparatuses for texturizing glass strand material which is fed into a muffler shell are described in U.S. Pat. Nos. 4,569,471 and 5,976,453, the disclosures of which are incorporated herein by reference by reference in their entireties. It is further contemplated that the fibrous material 18 may be inserted into the muffler in the form of mats of continuous or discontinuous fibers. Needled felt mats of discontinuous glass fibers may be inserted in the muffler as a preform or are rolled into a perforated tube which is then inserted into the muffler.

Acoustic energy passes through the perforated pipe 14 to the fibrous material 18 which functions to dissipate the acoustic energy. The fibrous material 18 also functions to thermally protect or insulate the outer shell 12 from energy in the form of heat transferred from high temperature exhaust gases passing through the pipe 14.

Figure 2A:
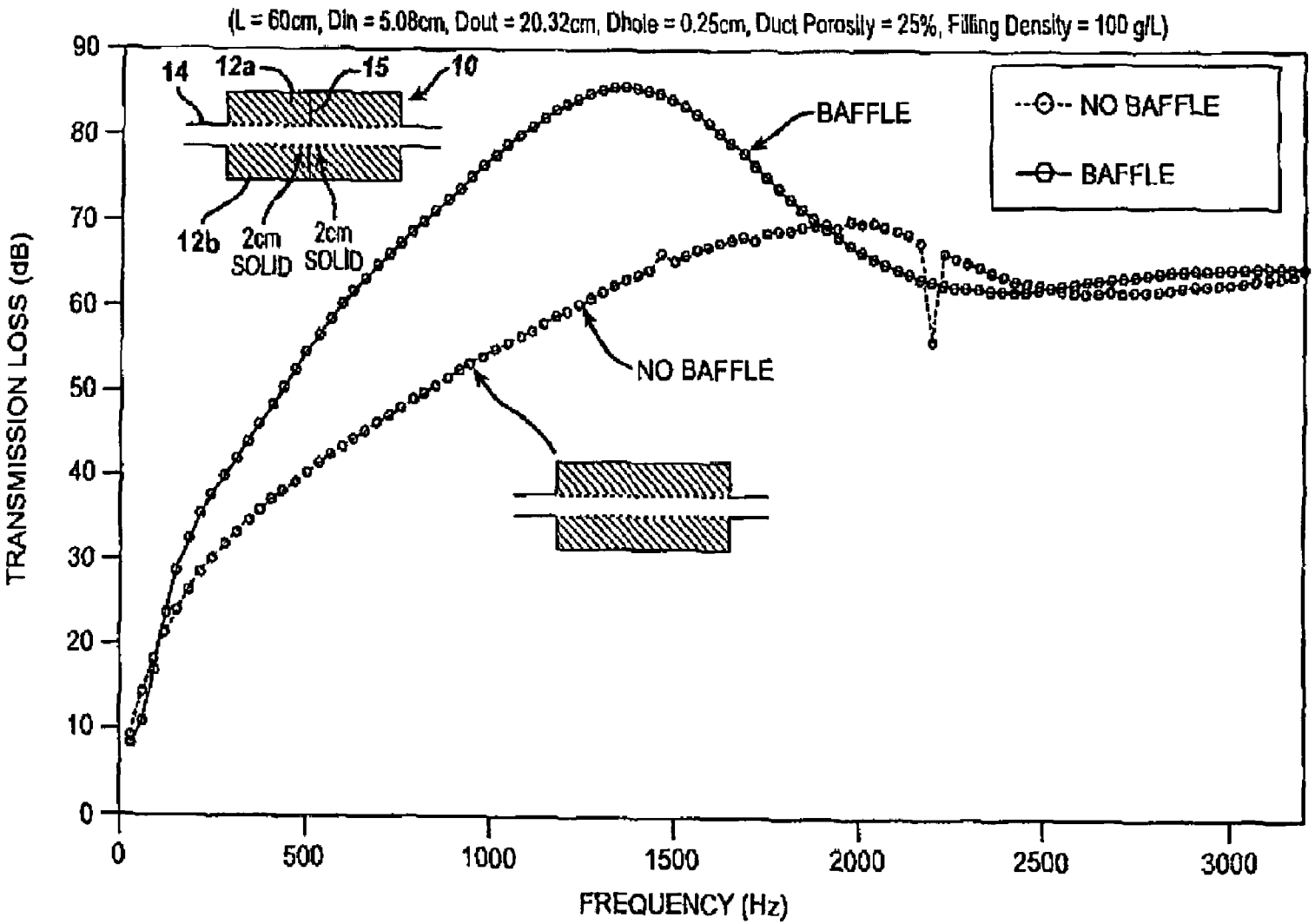
FIG. 2A is a graph of Transmission Loss (y) with no air flow verses Frequency (x) of boundary element method (BEM) predictions for a dissipative silencer with an internal baffle and a dissipative silencer without such a baffle.
Figure 5:
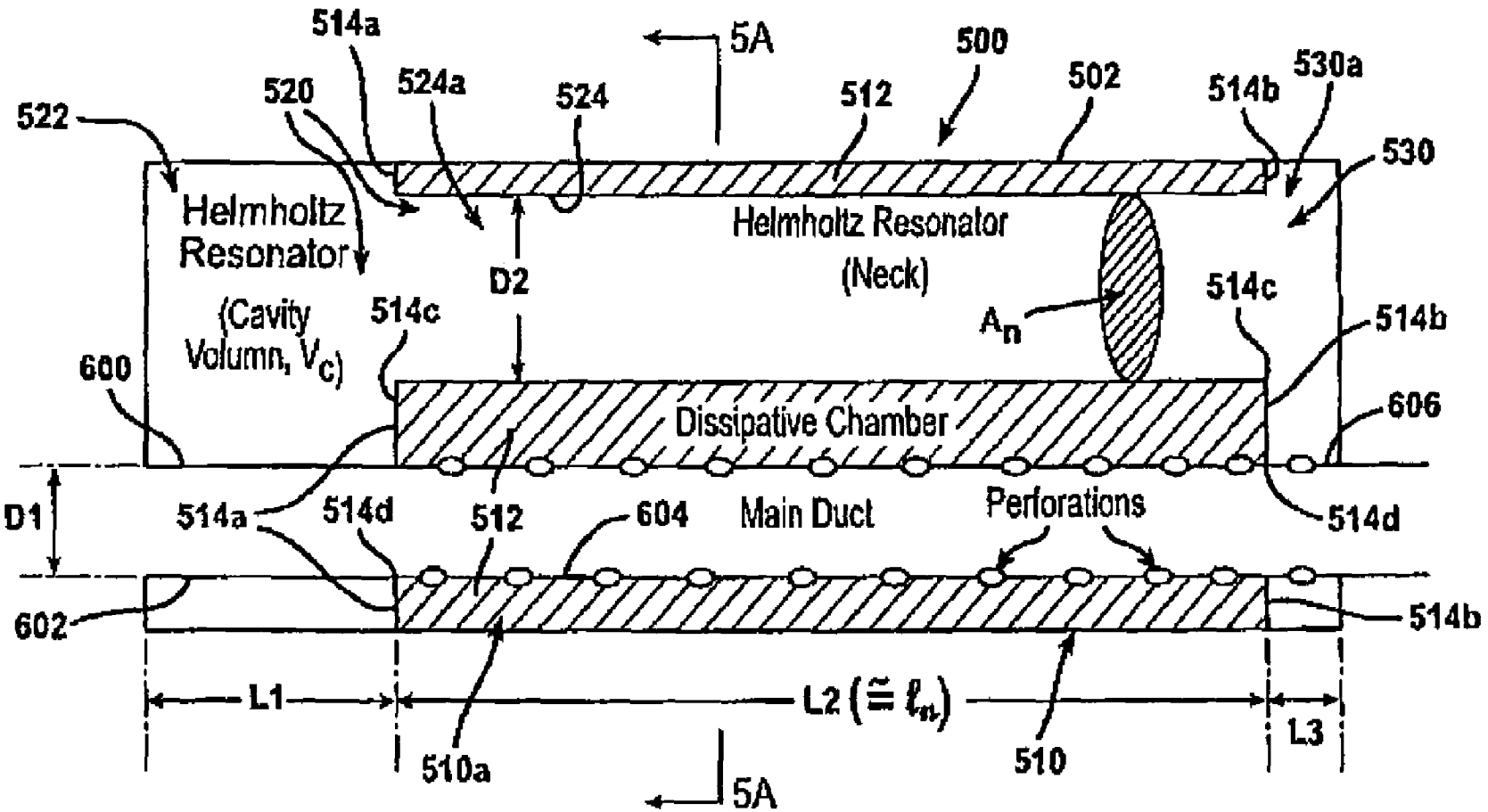
FIG. 5 is a plan view of a silencer of the present invention.

As noted above, the transmission loss of a silencer or muffler 10 filled with absorptive material 18 can be enhanced at certain frequency ranges by placing a baffle or plate 15 in the silencer inner chamber 13*a* so as to separate the silencer inner chamber 13*a* into two absorptive chambers 13*b* and 13*c*. Modeled transmission loss (dB) data is illustrated in FIG. 2A for a muffler 10 having a single baffle with the following dimensions: a shell length L equal to 60 cm; an outer shell diameter $D_s$ equal to 20.32 cm; a perforated tube 14 having an inner diameter $D_p$ equal to 5.08 cm; perforations in the tube 14 each having a diameter of 0.25 cm; total porosity in the perforated tube 14, i.e., perforated surface area/perforated and non-perforated tube surface area ×100, equal to 25%; and an absorptive material filling density of 100 grams/liter, and was configured as illustrated in FIG. 5.

Transmission loss is a measure in dB of the amount of sound energy that is attenuated as a sound wave passes through a muffler. In other words, transmission loss, at a given frequency, is equal to a sound level (dB) at the given frequency where no attenuation has occurred via a silencer or otherwise minus a sound level (dB) at that same frequency where some attenuation has occurred, such as by a silencer. As shown in FIG. 2A, when a baffle 15 is provided in the inner chamber 13*a*, the transmission loss or attenuated sound energy is increased at frequencies falling within the range of from about 150 Hz to about 1900 Hz compared to the transmission loss that occurs at those same frequencies when a muffler is used having equal dimensions but lacking a baffle 15. Accordingly, by separating an inner chamber 13*a* into first and second absorptive chambers 13*b* and 13*c* via baffle 15, a reduction in sound level, i.e., an increase in sound energy attenuation, can be achieved at mid to high frequencies. It is additionally contemplated that more than one baffle 15 may be provided so as to separate the inner chamber 13 into three or more inner chambers (not shown).

Figure 2B:
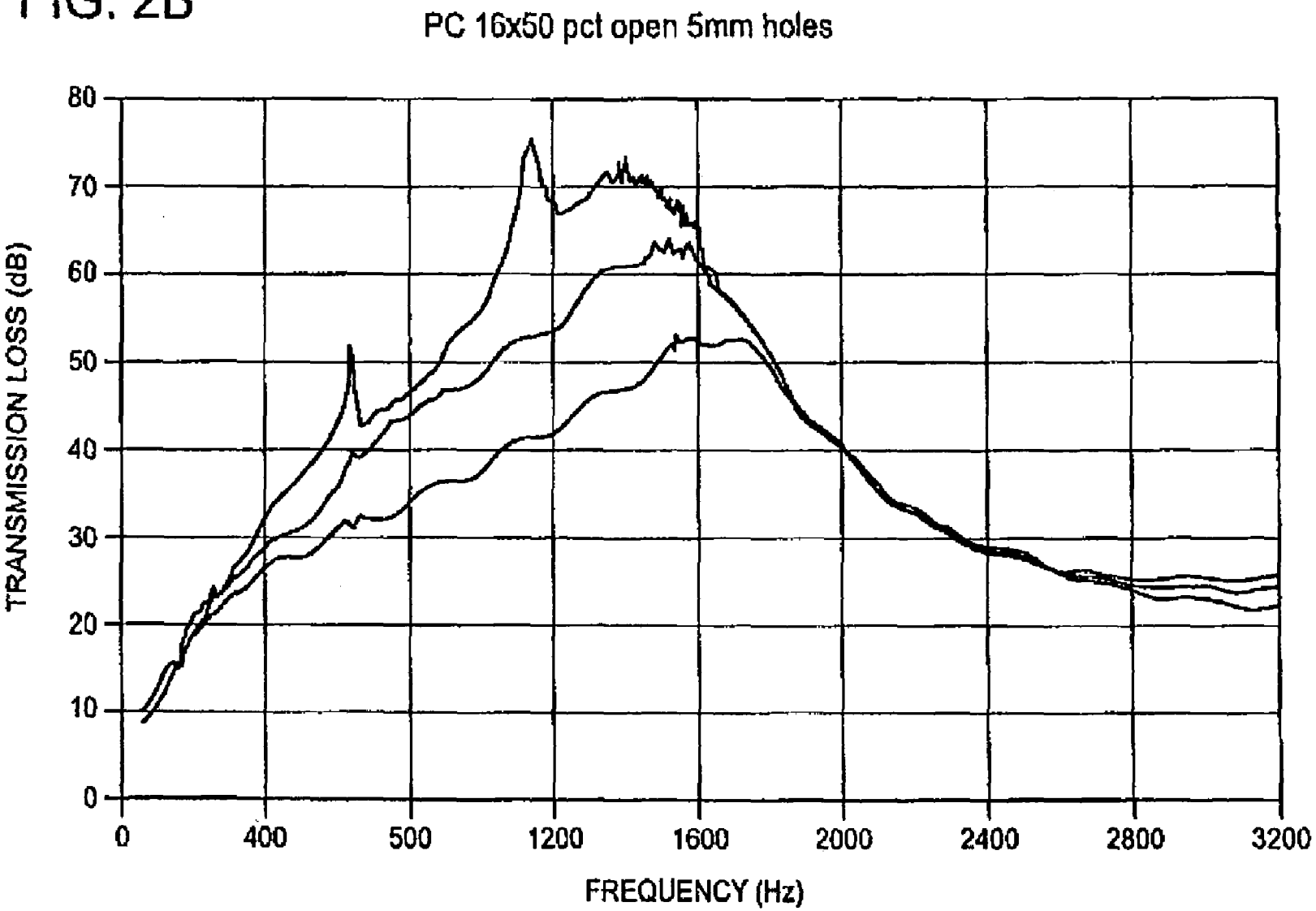
FIG. 2B is a graph of Transmission Loss (y) with no air flow verses Frequency (x) of experimental data generated for a dissipative silencer including one and two internal baffles and a dissipative silencer without such a baffle.

Actual measured transmission loss (dB) data is illustrated in FIG. 2B for mufflers having 0, 1, or 2 baffles. When one baffle 15 is provided, the silencer inner chamber 13 was separated into two substantially equal volume chambers and when two baffles were provided, the silencer inner chamber was separated into three substantially equal volume chambers. Each muffler had the following dimensions: a shell length L equal to 50.8 cm; an outer shell diameter $D_s$ equal to 16.4 cm; a perforated tube 14 having an inner diameter $D_p$ equal to 5 cm; perforations in the tube 14 each having a diameter of 5 mm; total porosity in the perforated tube 14, i.e., perforated surface area/non-perforated tube surface area ×100, equal to 8%; and an absorptive material filling density of 100 grams/liter and was configured as shown in FIG. 1A.

As is apparent from FIG. 2B, when one or two baffles were provided, the transmission loss or attenuated sound energy was increased at frequencies falling within the range of from about 150 Hz to about 1900 Hz when compared to the transmission loss that occurred at those same frequencies when a muffler was used having equal dimensions but lacking a baffle. Accordingly, by separating a silencer inner chamber into two or three chambers via one or two baffles, a reduction in sound level, i.e., an increase in sound energy attenuation, is achieved at mid to high frequencies.

Figure 3:
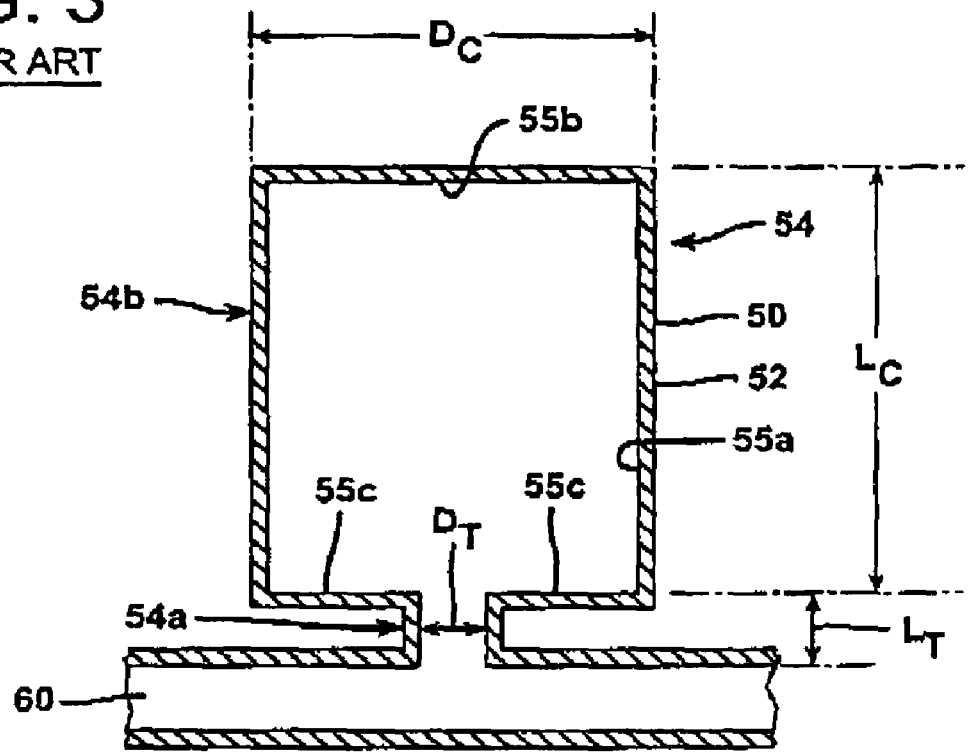
FIG. 3 PRIOR ART
FIG. 3 is a plan view of a prior art Helmholtz resonator positioned as a side branch to an exhaust system.

FIG. 3 schematically illustrates a muffler 50 including a rigid outer shell 52 formed from a metal, a resin, or a composite material including, for example, reinforcement fibers and a resin material. Example of outer shell composite materials are described in the '972 patent. The muffler 50 is coupled to a non-perforated exhaust pipe 60.

The muffler 50 includes a Helmholtz resonator 54 comprising a throat portion 54*a* having an inner diameter $D_T$ and a length $L_T$, and a chamber portion 54*b* having an inner diameter $D_C$ and a length $L_C$.

Typically, the peak attenuation frequency of sound energy, i.e., the frequency at which the greatest transmission loss occurs, is a function of the volume of the chamber portion 54*b* of the Helmholtz resonator 54 and the throat portion inner diameter $D_T$, and length $L_T$. For example, if the chamber volume increases and the throat portion inner diameter $D_T$, and length $L_T$ remain the same, the peak attenuation frequency decreases, and if the chamber volume decreases, the peak attenuation frequency increases.

The peak attenuation frequency is lowered without increasing the volume of the chamber portion 54*b* by lining one or more inner walls of the chamber portion 54*b* with an acoustically absorbing material 70. In the embodiment illustrated in FIG. 3, first and second inner walls 55*a* and 55*b* of the chamber portion 54*b* are lined with fibrous material 70*a*. A third wall 55*c* is unlined. Alternatively, any one or more of the inner walls 55*a*-55*c* may be lined.

The fibrous material 70*a* may be formed from one or more continuous glass filament strands, wherein each strand comprises a plurality of filaments which are separated or texturized via pressurized air so as to form a loose wool-type product, see U.S. Pat. Nos. 5,976,453 and 4,569,471, the disclosures of which are incorporated herein by reference. The filaments may be formed from, for example, E-glass or S2-glass, or other glass compositions. The continuous strand material may comprise an E-glass roving sold by Owens Corning under the trademark ADVANTEX® or an S2-glass roving sold by Owens Corning under the trademark ZenTron®.

It is also contemplated that continuous or discontinuous ceramic fiber material may be used instead of glass fibrous material to line the walls 55*a*-55*b* of the chamber portion 54*b*. The fibrous material 70*a* may also comprise loose discontinuous glass fibers, e.g., E glass fibers, or ceramic fibers, or a discontinuous glass fiber product produced via a rock wool process or a spinner process similar to those used to make fiber glass thermal insulation for residential and commercial applications, or a glass mat. FIG. 3 schematically illustrates such a muffler 50 which includes a rigid outer shell 52, a Helmholtz resonator 54 which includes a throat portion 54*a* having an inner diameter $D_T$, and a length $L_T$, and a chamber portion 54*b* having an inner diameter $D_C$, and a length $L_C$.

Figure 3A:
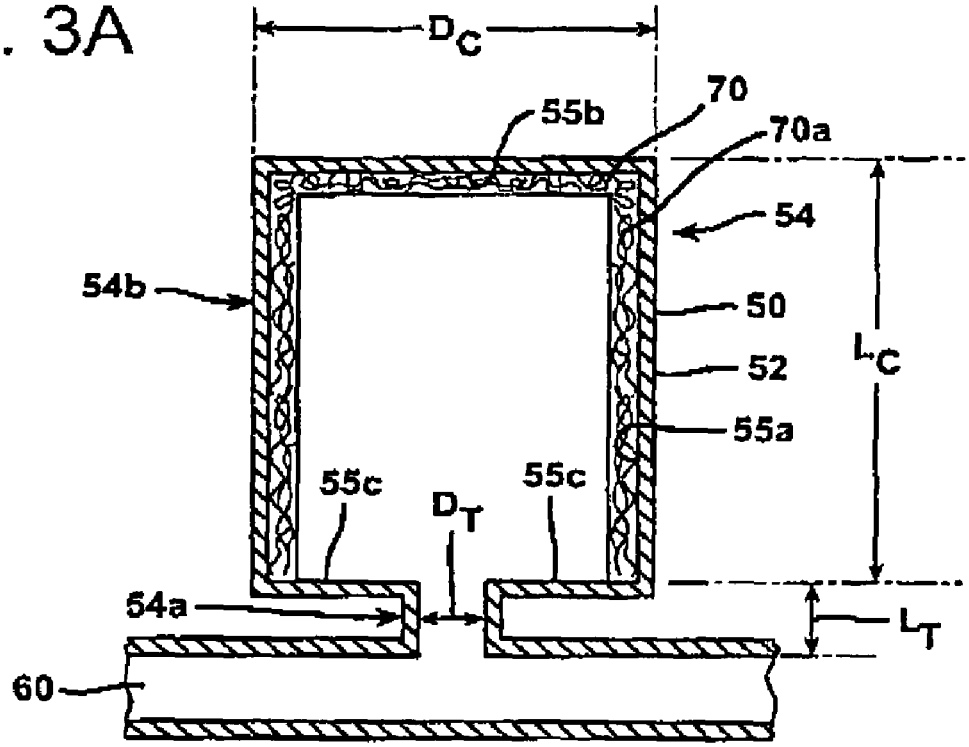
FIG. 3A is a plan view of a Helmholtz resonator lined with a fibrous material positioned as a side branch to an exhaust system.

When the Helmholtz resonator 54 is attached as a side branch, as shown in FIG. 3A, and contains or is lined with fibrous material as discussed in EXAMPLE 1 the Transmission Loss v. Frequency curve was substantially broadened, to provide improved loss at a wider range of frequencies.

EXAMPLE I

As shown in FIG. 3A, muffler 50 was provided comprising a rigid outer shell 52 formed from polyvinyl chloride (PVC). The muffler 50 comprised a Helmholtz resonator 54 including a throat portion 54*a* having a diameter $D_T$=4 cm and a length $L_T$=8.5 cm and a chamber portion 54*b* having an inner diameter $D_C$=15.24 cm and a length $L_C$=20.32 cm. During a first test, no inner wall of the inner chamber portion 54*b* was lined with fibrous material 70*a*. During a second test, the first and second walls 55*a*-55*b* were lined with approximately 1 inch of fibrous material 70*a* at a fill density of about 100 grams/liter. During a third test, the first and second walls 55*a*-55*b* were lined with approximately 2 inches of fibrous material 70*a* at a fill density of about 100 grams/liter. During a fourth test, the entire chamber portion 54*b* was filled with fibrous material 70*a* at a fill density of about 100 grams/liter. During a fifth test, the first and second walls 55*a*-55*b* were lined with approximately 1 inch of fibrous material 70*a* at a fill density of about 63 grams/liter. For tests 2-5, the fibrous material 70*a* comprised textured glass filaments, which are commercially available from Owens Corning under the product designation ADVANTEX® 162 For tests 2, 3, and 5, the fibrous material 70*a* was secured to the inner walls 55*a*-55*b* via a wire mesh screen having a 75% open area or porosity.

Figure 4:
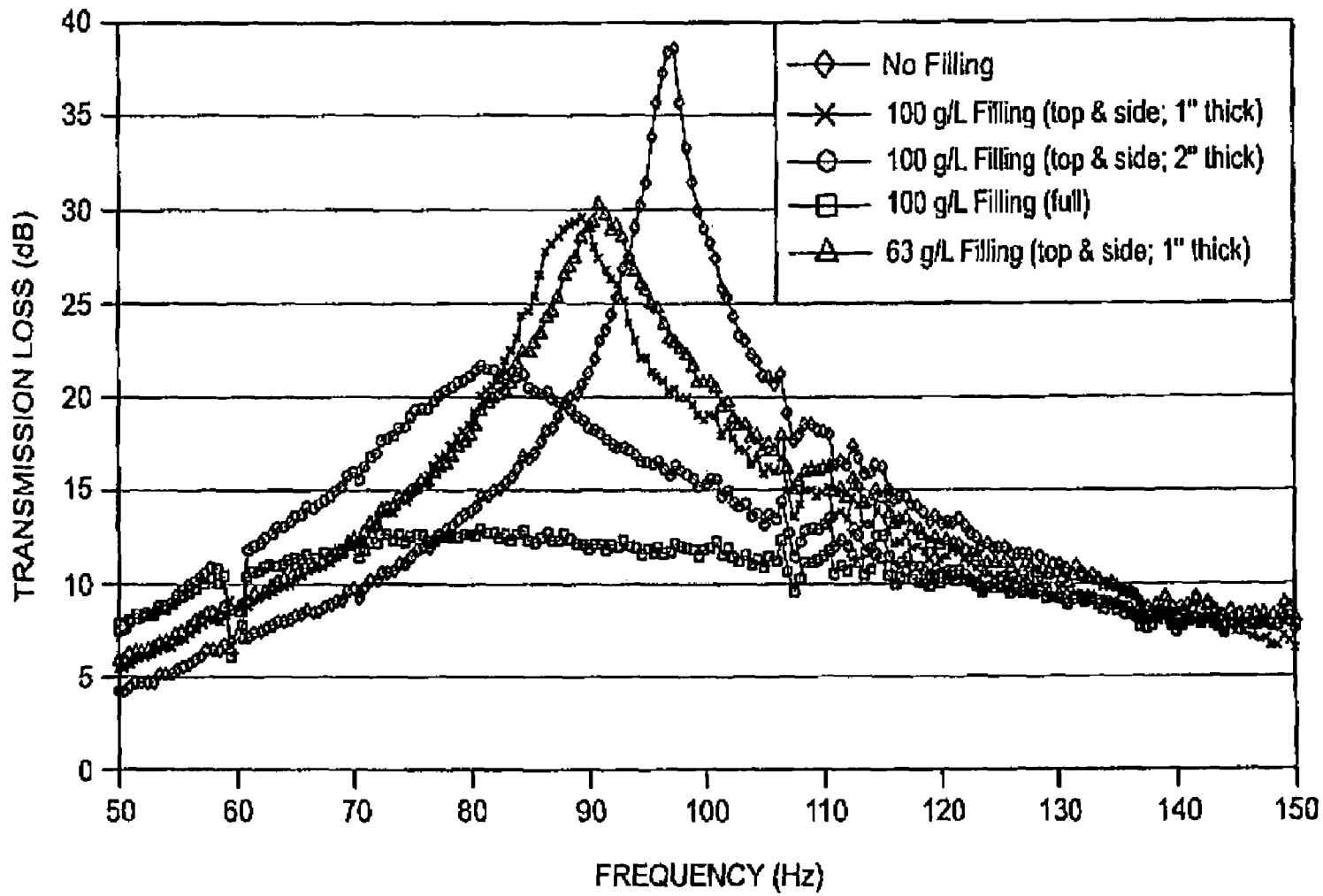
FIG. 4 is a graph of Transmission Loss (y) with no air flow verses Frequency (x) of experimental data generated for a Helmholtz resonator including various amounts of a fibrous fill material.

FIG. 4 illustrates transmission loss vs. frequency at ambient temperatures for each of the five tests conducted. As is apparent from FIG. 4 that during the first test, where no filling was provided within the chamber portion 54*b*, peak frequency attenuation occurred at about 97 Hz. The transmission loss at 97 Hz was approximately 39 dB. The half-height frequency attenuation points on that curve occurred at frequencies of 89 Hz and 106 Hz. The transmission loss at 89 Hz and 106 Hz was approximately 20 dB.

During the second test, where the first and second walls 55*a*-55*b* were lined with approximately 1 inch of fibrous material 70*a* at a fill density of about 100 grams/liter, peak frequency attenuation occurred at about 90 Hz. The transmission loss at 90 Hz was approximately 30 dB. The half-height frequency attenuation points on the second test curve were at frequencies of 75 Hz and 108 Hz. The transmission loss at 75 Hz and 108 Hz was approximately 15 dB.

During the third test, where the first and second walls 55*a*-55*b* were lined with approximately 2 inches of fibrous material 70*a* at a fill density of about 100 grams/liter, peak frequency attenuation occurred at about 81 Hz. The transmission loss at 81 Hz was approximately 22 dB. The half-height frequency attenuation points on the third test curve were at frequencies of 58 Hz and 117 Hz. The transmission loss at 58 Hz and 117 Hz was approximately 11 dB.

During the fourth test, where the entire chamber portion 54*b* was filled with fibrous material 70*a* at a fill density of about 100 grams/liter, peak frequency attenuation occurred at about 74 Hz. The transmission loss at 74 Hz was approximately 12 dB. The transmission loss curve was substantially flat in shape.

During the fifth test, where the first and second walls 55*a*-55*b* were lined with approximately 1 inch of fibrous material 70*a* at a fill density of about 63 grams/liter, peak frequency attenuation occurred at about 91 Hz. The transmission loss at 91 Hz was approximately 30 dB. The half-height frequency attenuation points on the second test curve were at frequencies of 75 Hz and 113 Hz. The transmission loss at 75 Hz and 113 Hz was approximately 15 dB.

With regard to each of tests 2, 3 and 5, where the walls 55*a*-55*b* of the chamber portion 54*b* were lined with fibrous material 70*a*, the frequency at which peak sound energy absorption occurred was lowered and the range of frequencies at which a transmission loss equal to approximately half that occurring at the peak attenuation frequency was broadened. Therefore, by lining the walls 55*a*-55*b* of the chamber portion 54*b* with fibrous material 70*a*, a broader half-height attenuation range (i.e., a range of frequencies between end points falling on the transmission loss curve where a transmission loss occurred equal to approximately one-half of that occurring at the peak attenuation frequency) was provided. It was noted that the peak absorption or attenuation frequency typically shifted with temperature changes. It was also noted that the peak noise frequency to be attenuated typically shifted with engine RPM. Thus, a muffler or silencer having a narrow half-height attenuation range may be found to be unacceptable as the peak noise frequency may move outside of the attenuation range during operation of the vehicle, i.e., as the engine speed varies. Because a broader half-height attenuation range is provided by an aspect of the present invention, it is more likely that the attenuation effected by the muffler 50 will be found to be acceptable during operation of a vehicle, i.e., as the motor speed varies and secondarily as the muffler temperature varies. Further with regard to tests 2, 3 and 5, it was noted that the frequency of peak attenuation was reduced without increasing the dimensions of the chamber portion 54*b* or throat portion 54*a*.

It was also noted that by lining the walls 55*a*-55*b* of the chamber portion 54*b* with fibrous material 70*a*, heat transfer to the walls 55*a*-55*b* was reduced, thereby allowing the muffler outer shell 52 to stay cooler. Consequently, the outer shell 52 may be formed from a material having a lower heat resistance threshold, such as a composite material.

FIG. 5 illustrates in cross section a muffler or silencer 500 constructed in accordance with a first embodiment of another aspect of the present invention. The silencer 500 comprises a hybrid silencer including a dissipative silencer component 510 and a reactive element component 520, i.e., a Helmholtz resonator. The silencer 500 further includes a connection component 530 for joining or connecting the dissipative silencer component 510 with the Helmholtz resonator component 520. The dissipative silencer component 510 comprises acoustically absorbing material 512, such as fibrous material 512*a*, and exhibits a desirable broadband noise attenuation at frequencies above about 150 Hz. The Helmholtz resonator component 520 exhibits desirable noise attenuation at low frequencies, e.g., from about 50 to about 120 Hz at 25° C., typical of low-speed internal combustion engine noise as well as low-order airborne noise. Hence, the silencer 500 is an effective attenuator over a wide range of frequencies.

The silencer 500 comprises a rigid outer shell 502 formed from a metal, a resin or a composite material comprising, for example, reinforcement fibers and a resin material. Example outer shell composite materials are set out in the '972 patent. The outer shell 502, in the illustrated embodiment, preferably has a substantially oval shape. The outer shell 502 may have any other geometric shape so long as the requisite volumes for the dissipative silencer component 510 and the Helmholtz resonator component 520 to effect the desired attenuation are retained.

A pipe, typically with no abrupt bends, such as the substantially straight pipe 600 illustrated in FIG. 5, is coupled to the rigid outer shell 502 and extends through the entire length of the outer shell 502. A pipe with no abrupt bends may include pipes having a slight bend or angle, an S-shaped pipe, etc. Conventional exhaust pipes, not shown, may be coupled to outer ends of the pipe 600. Because the pipe 600 is formed with no abrupt bends, back pressure and flow losses through the silencer 500 are reduced. The pipe 600 is preferably spaced a sufficient distance away from the inner wall 502*a* of the outer shell 502 so as to allow a sufficient amount of fibrous material 512 to be provided between the pipe 600 and the shell inner wall 502*a* to allow for adequate thermal and acoustical insulation of the outer shell 502 and to prevent interference by the outer shell 502 with acoustic attenuation by the dissipative component 510.

A first portion 602 of the pipe 600, which is not perforated, extends through a cavity 522 of the Helmholtz resonator component 520. A second portion 604 of the pipe 600 is perforated and forms part of the dissipative silencer component 510. A third portion 606 of the pipe 600 is also perforated and forms part of the connection component 530, which, as noted above, joins the dissipative component 510 with the reactive component 520. The second portion 604 of the pipe 600 is perforated so as to have a porosity, i.e., a percentage of open area to closed area, of between about 5% to about 60%. The third portion 606 of the pipe 600 is perforated so as to have a porosity of between about 20% to about 100%.

Figure 5A:
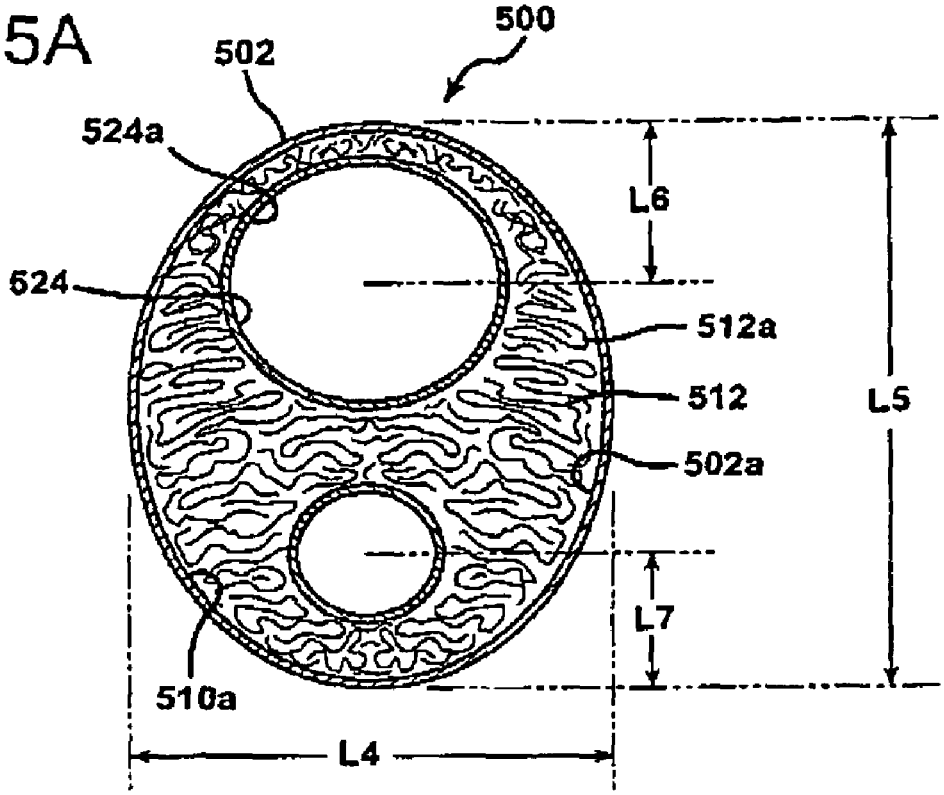
FIG. 5A is a cross-section of FIG. 5 taken along line 5A.

In the illustrated embodiment, the dissipative silencer component 510 comprises a substantially oval cavity 510*a* having a length L2, a height L5 and a width L4, see FIGS. 5 and 5A. Passing through the cavity 510*a*, and forming part of the dissipative silencer component 510 is the pipe portion 604. Pipe 524 forming a neck portion 524*a* of the Helmholtz resonator component 520 also passes through the cavity 510*a*, but does not form part of the dissipative silencer component 510.

The dissipative silencer component 510 further comprises fibrous material 512*a*. The fibrous material 512*a* may be formed from one or more continuous glass filament strands, wherein each strand comprises a plurality of filaments which are separated or texturized via pressurized air so as to form a loose wool-type product, see U.S. Pat. Nos. 5,976,453 and 4,569,471, the disclosures of which are incorporated herein by reference. The filaments may be formed from, for example, E-glass or S2-glass, or other glass compositions. The continuous strand material may comprise an E-glass roving sold by Owens Corning under the trademark ADVANTEX® or an S2-glass roving sold by Owens Corning under the trademark ZenTron®.

It is also contemplated that continuous or discontinuous ceramic fiber material may be used instead of glass fibrous material for filling the cavity 510*a*. The fibrous material 512*a* may also comprise loose discontinuous glass fibers, e.g., E glass fibers, or ceramic fibers, a discontinuous glass fiber product produced via a rock wool process or a spinner process similar to those used to make fiber glass thermal insulation for residential and commercial applications, or a glass mat.

End plates 514*a* and 514*b*, each having a first opening 514*c* with a diameter D2 and a second opening 514*d* with a diameter D1 are provided for retaining the fibrous material 512*a* in the cavity 510*a*. The end plates 514*a* and 514*b* are coupled to the outer shell 502 and are oval in shape. The end plates 514*a* and 514*b* may have one or more additional holes to facilitate filling of the cavity 510*a* with fibrous material.

The Helmholtz resonator component 520 comprises the cavity portion 522 and the neck portion 524*a*. The cavity portion 522 has a substantially oval shape in cross section, a length L1, a height L5 and a width L4, see FIGS. 5 and 5A. Passing through the cavity portion 522, and not forming part of the Helmholtz resonator component 520 is the pipe portion 602. The neck portion 524*a* is defined by the pipe 524, which has a cross sectional area $A_n$, a diameter D2 and a length L2.

The connection component 530 comprises a substantially oval cavity 530*a* having a length L3, a height L5 and a width L4, see FIG. 5A. Passing through the cavity 530*a*, and forming part of the connection component 530 is the pipe third portion 606. It is preferred that the length L3 be as short as possible, e.g., from about 1 cm to about 10 cm, as a short length L3 typically corresponds to a peak attenuation frequency at a lower frequency. It is further preferred that the third portion 606 of the pipe 600 be perforated so as to have a high porosity, i.e., a percentage of open area to closed area, of between about 20% to about 100%.

Figure 6A:
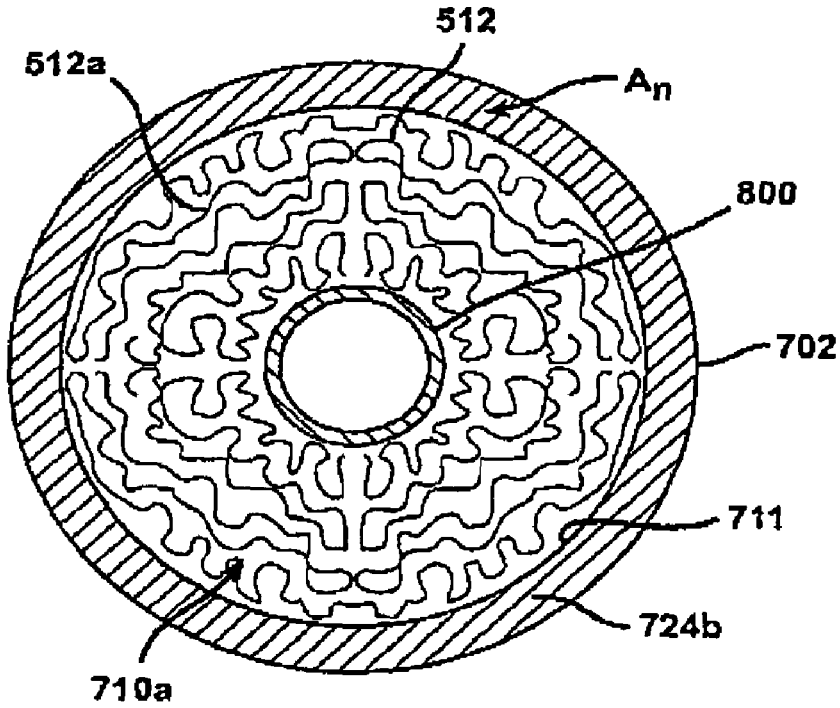
FIG. 6A is a cross-section of FIG. 6 taken along line 6A.
Figure 6:
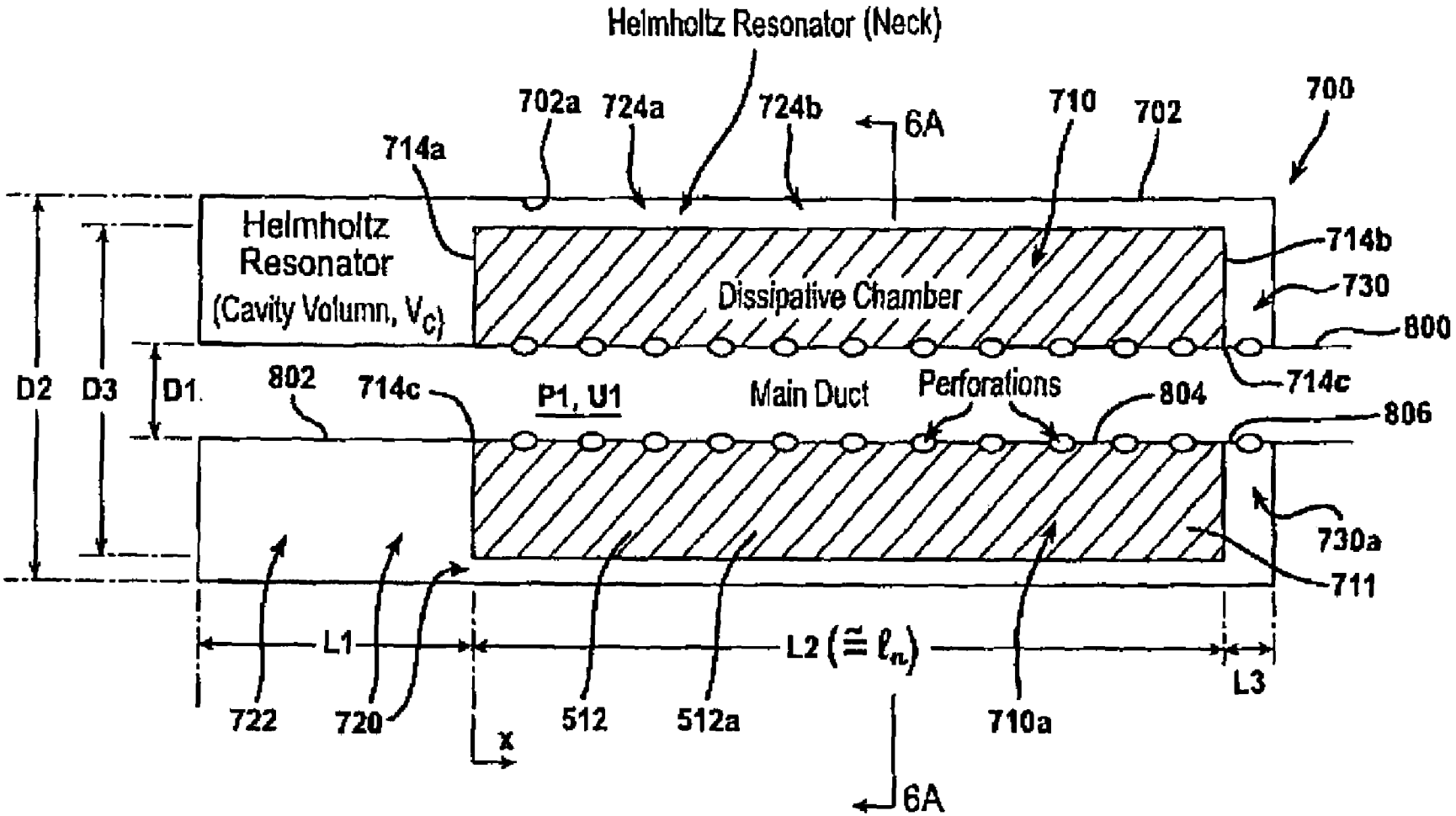
FIG. 6 is a plan view of a silencer of the present invention.

FIG. 6 illustrates in cross section a muffler or silencer 700 constructed in accordance with another aspect of the present invention. The silencer 700 comprises a hybrid silencer including a dissipative silencer component 710 and a reactive element component 720, i.e., a Helmholtz resonator. The silencer 700 further includes a connection component 730 for joining the dissipative silencer component 710 with the Helmholtz resonator component 720. The dissipative silencer component 710 comprises acoustically absorbing material 512, such as fibrous material 512*a*, and exhibits a desirable broadband noise attenuation at frequencies greater than about 150 Hz. The Helmholtz resonator component 720 exhibits desirable noise attenuation at low frequencies, e.g., from about 50 Hz to about 120 Hz at 25° C., typical of low-speed internal combustion engine noise as well as low-order airborne noise. Hence, the silencer 700 is an effective attenuator over a wide range of frequencies.

The silencer 700 comprises a rigid outer shell 702 formed from a metal, a resin or a composite material comprising, for example, reinforcement fibers and a resin material. Examples of outer shell composite materials are set out in the '972 patent. The outer shell 702, in the illustrated embodiment, has a substantially cylindrical shape. The outer shell 702 may have any other geometric shape so long as the requisite volumes for the dissipative silencer component 710 and the Helmholtz resonator component 720 to effect the desired attenuation are retained.

A substantially straight pipe 800 is coupled to the outer shell 702 and extends through the entire length of the outer shell 702. Conventional exhaust pipes, not shown, may be coupled to outer ends of the pipe 800. Because the pipe 800 is formed without abrupt bends, back pressure and flow losses through the silencer 700 are reduced.

A first portion 802 of the pipe 800, which is substantially solid and not perforated, extends through a cavity 722 of the Helmholtz resonator component 720. A second portion 804 of the pipe 800 is perforated and forms part of the dissipative silencer component 710. A third portion 806 of the pipe 800 is also perforated and forms part of the connection component 730, which, as noted above, joins the dissipative component 710 with the reactive component 720. The second portion 804 of the pipe 800 is perforated so as to have a porosity of between about 5% to about 60%. The third portion 806 of the pipe 800 is perforated so as to have a porosity of between about 20% to about 100%.

In the illustrated embodiment, the dissipative silencer component 710 comprises a substantially cylindrical cavity 710*a* defined between an inner, substantially straight, non-perforated pipe 711 and the pipe 800. The cavity 710*a* has an outer diameter D3, an inner diameter D1 and a length L2, see FIGS. 6 and 6A. Passing through the cavity 710*a*, and forming part of the dissipative silencer component 710 is the pipe portion 804. The dissipative silencer component 710 further comprises fibrous material 512*a*, such as described above with regard to the embodiment illustrated in FIGS. 5 and 5A.

End plates 714*a* and 714*b*, each having a first opening 714*c* with a diameter D1 are provided for retaining the fibrous material 512*a* in the cavity 710*a*. The end plates 714*a* and 714*b* may be welded or otherwise coupled to the pipe 800. Further, support elements (not shown) may extend from the plates 714*a* and 714*b* and be coupled to the outer shell 702. The end plates 714*a* and 714*b* may have one or more additional holes to facilitate filling of cavity 710*a* with fibrous material.

The Helmholtz resonator component 720 comprises the cavity portion 722 and a neck portion 724*a*. The cavity 722 has a substantially cylindrical shape in cross section, a length L1 an outer diameter D2 and an inner diameter D1. Passing through the cavity portion 722, and not forming part of the Helmholtz resonator component 720 is the pipe portion 802. The neck portion 724*a* defines a hollow, ring-shaped cavity 724*b* having a length L2, an outer diameter D2 and an inner diameter D3, see FIGS. 6 and 6A.

The connection component 730 comprises a substantially cylindrical cavity 730*a* having a length L3, an outer diameter D2 and an inner diameter D1, see FIGS. 6 and 6A. Passing through the cavity 730*a*, and forming part of the connection component 730 is the pipe portion 806. It is preferred that the length L3 be as short as possible, e.g., from about 1 cm to about 10 cm, as a short length L3 typically corresponds to a peak attenuation frequency at a lower frequency. It is further preferred that the third portion 806 of the pipe 800 be perforated so as to have a high porosity, i.e., a percentage of open area to closed area, of between about 20% to about 100%.

For a simple dissipative silencer component geometry, such as the cylindrical cavity 710*a* illustrated in FIGS. 6 and 6A, and low frequencies, a one-dimensional analytical method can be used to predict the acoustic behavior of the dissipative silencer component 710, as will now be described. For harmonic planar wave propagation in both the pipe portion 804 and the cylindrical cavity 710*a* in FIGS. 6 and 6A, the continuity and momentum equations yield, in the absence of mean flow, $$\frac{d^2 p_1}{dx^2} + \left(k^2 - \frac{4}{D_1}\frac{ik}{\zeta_p^{\%}}\right)p_1 + \frac{4}{D_1}\frac{ik}{\zeta_p^{\%}}p_2 = 0 \tag{2}$$

$$\frac{d^2 p_2}{dx^2} + \left(\frac{4D_1}{D_3^2 - D_1^2}\frac{\rho^{\%}}{\rho_0}\frac{ik}{\zeta_p^{\%}}\right)p_1 + \left(k^{\%} - \frac{4D_1}{D_3^2 - D_1^2}\frac{\rho^{\%}}{\rho_0}\frac{ik}{\zeta_p^{\%}}\right)p_2 = 0 \tag{3}$$

where $\rho_0$ and k denote, respectively, the density and the wave number in air, and $\rho^{0/1}$ and $k^{0/1}$ the complex dynamic density and the wave number in the absorptive material, $\zeta_p^{0/0}$ the nondimensionalized acoustic impedance of perforation. In view of the decoupling approach and rigid boundary conditions (u=0) at the wall of the cylindrical cavity 710*a*, the acoustic pressure (p) and particle velocity (u) at the inlet (x=0) and outlet (x=L2) of the dissipative silencer component pipe portion 804 may be related by the following equation (4):

$$\begin{bmatrix} p_1(x=0) \\ \rho_0 c_0 u_1(x=0) \end{bmatrix} = \begin{bmatrix} T_{11} & T_{12} \\ T_{21} & T_{22} \end{bmatrix} \begin{bmatrix} p_1(x=L2) \\ \rho_0 c_0 u_1(x=L2) \end{bmatrix}, \tag{4}$$

which defines the transfer matrix elements, $T_{ij}$($c_0$=speed of sound). For a pipe portion 804 with a constant cross-sectional area, transmission loss can then be calculated from the transfer matrix as follows:

$$TL = 20\log_{10}\left(\frac{1}{2}\left|T_{11} + T_{12} + T_{21} + T_{22}\right|\right). \tag{5}$$

The perforate impedance $\zeta_p^{0/0}$ relates the acoustic pressures in the pipe portion 804 and the cylindrical cavity 710*a* at the interface. Semi-empirical acoustic impedance of perforation facing absorptive fibrous material 512*a* can be expressed in terms of the hole geometry and acoustic properties of the absorptive fibrous material 512*a* as $$\zeta_p^{\%} = \left[C_1 + ik\left\{t_w + C_2 d_h\left(1 + \frac{\rho^{\%\%}}{\rho_0 c_0}\frac{k^{\%}}{k}\right)\right\}\right] \Big/ \phi, \tag{6}$$

where $t_w$ is the thickness of the wall of the pipe portion 804, $d_h$ the perforation hole diameter, $\phi$ the porosity of the pipe portion 804, $C_1$ and $C_2$ are coefficients determined experimentally. The acoustic properties of absorptive material can also be obtained experimentally and expressed as a function of frequency (f) and flow resistivity (R), $$\frac{\rho^{\%\%}}{\rho_0 c_0} = [1 + C_3(f/R)^{-n_1}] - i[C_4(f/R)^{-n_2}], \tag{7}$$

$$\frac{k^{\%}}{k} = [1 + C_5(f/R)^{-n_3}] - i[C_6(f/R)^{-n_4}], \tag{8}$$

where coefficients $C_3$–$C_6$ and exponents $n_1$–$n_4$ are dependent on the properties of the absorptive fibrous material 512*a*. Details of this analysis are set forth in the publication: A. Selamet, I. J. Lee, Z. L. Ji, and N. T. Huff, "Acoustic attenuation performance of perforated absorbing silencers," *SAE Noise and Vibration Conference and Exposition*, April 30-May 3, SAE Paper No. 2001-01-1435, Traverse City, Mich., which is incorporated herein by reference in its entirety ("SAE Paper No. 2001-01-1435").

The Helmholtz resonator components 520 and 720 are effective acoustic attenuation devices at low frequencies. Each has a resonance, i.e., peak attenuation frequency, dictated by the combination of its cavity portion 522, 722 and neck portion 524*a*, 724*a*, their dimensions and relative orientations. The resonance frequency may be approximated by the classical lumped analysis given by:

$$f_r = \frac{c_0}{2\pi}\sqrt{\frac{A_n}{V_c l_n}}, \tag{9}$$

where $c_0$ is the speed of sound, $A_n$ the neck portion cross-sectional area, $V_c$ the cavity portion volume, $l_n$ the neck portion length, see FIGS. 5, 6 and 6A. The desirable low resonance frequency for sound attenuation applications, such as internal combustion engine attenuation applications, may therefore be achieved by a large cavity portion volume (corresponding to lengths L1 L4, and L5, and diameter D1 in FIG. 5 or length L1 and diameters D1 and D2 in FIG. 6) and a long neck portion (corresponding mainly to length L2 and diameter D2 in FIG. 5 or length L2 and diameters D2 and D3 in FIG. 6). A large cross-sectional area $A_n$ (corresponding to length L2 and diameter D2 in FIG. 5 and to the area defined between diameters D2 and D3 in FIG. 6) is unfavorable for a low resonance frequency; however, it may yield a desirable broader transmission loss. The Helmholtz resonator components 520 and 720 of FIGS. 5 and 6 are designed based on these criteria. Specific dimensions of the Helmholtz resonator 520, 720 will be dictated by the dominant low frequency source in the application for which attenuation is intended. The preliminary designs based on the foregoing equation may be improved and finalized by using multi-dimensional acoustic prediction tools, such as a Boundary Element Method, see SAE Paper No. 2001-01-1435.

EXAMPLE II

A silencer was constructed as shown in FIGS. 5 and 5A having the following dimensions: L1=9 cm; L2=48 cm; L3=3 cm, perforations created a porosity of about 30% in the third portion 606 of the pipe 600; L4=17.8 cm; L5=22.9 cm; L6=1.9 cm; L7=5.7 cm; D1=5.1 cm; D2=8.9 cm. The oval cavity 510*a* was filled at a fill density of about 100 grams/liter with fibrous material 512*a* comprising texturized glass filaments, which are commercially available from Owens Corning under the product designation ADVANTEX® 162A.

Test apparatus (not shown) was provided comprising a source of sound energy, an input pipe coupled to an inlet of the pipe 600 and an output pipe coupled to the outlet of the pipe 600. Microphones were provided at the input and output pipes for sensing sound pressure levels at those locations for frequencies from about 20 Hz to about 3200 Hz. Sound transmission losses at each frequency were determined from the signals generated by those microphones. Experiments were performed with all elements at ambient temperatures.

During a first test run, the input and output pipes were two inches in diameter, approximately equal to the diameter of the pipe 600. During a second test run, the input and output pipes were three inches in diameter. Three-inch-to-two-inch transition sections were provided between the input and output pipes and the inlet and outlet ends of the pipe 600.

Figure 7A:
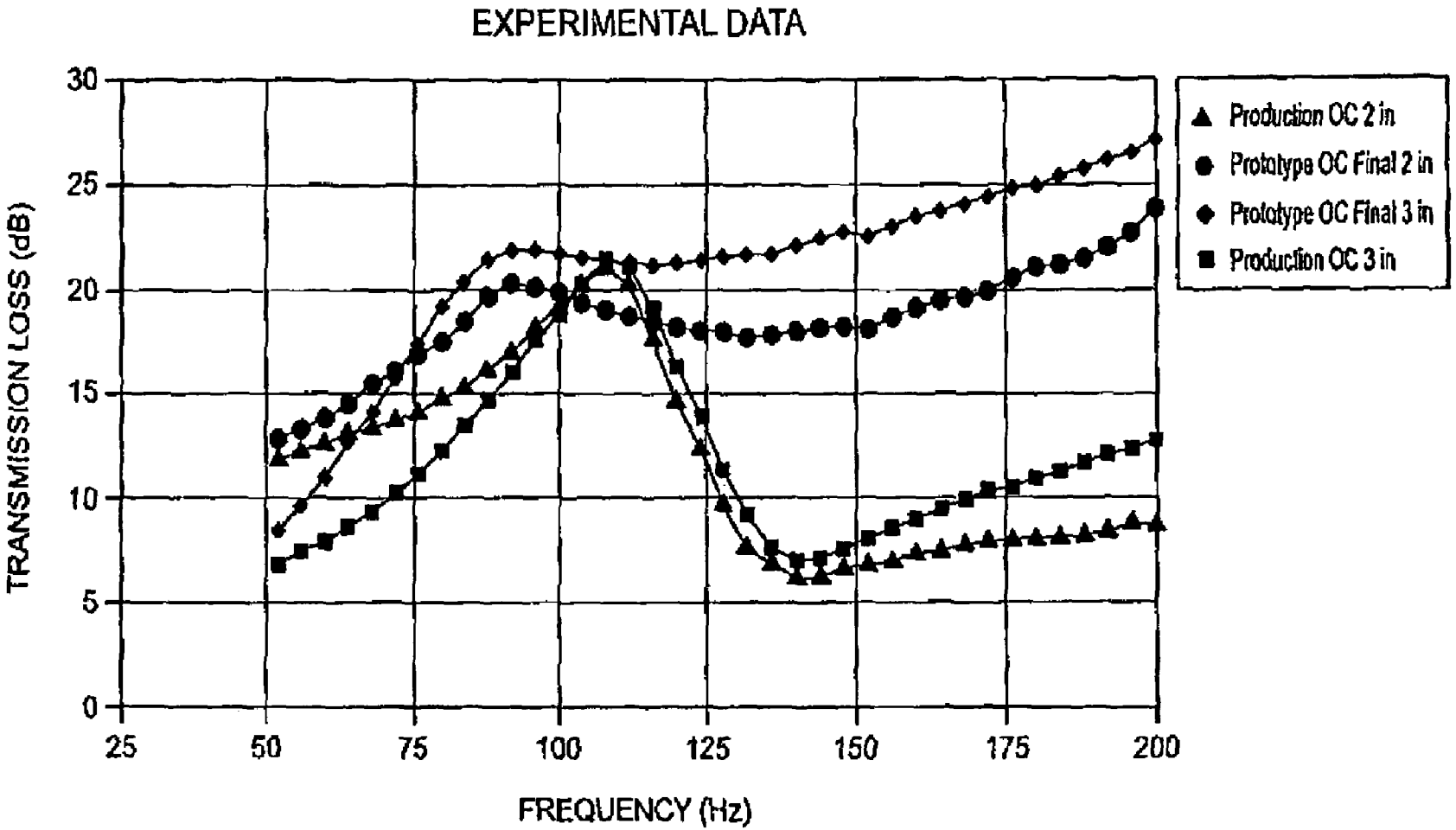
FIG. 7A is a graph of Transmission Loss (y) with no air flow verses Frequency (x) of experimental data generated for 4 prototypes of silencers according to embodiments of the present invention and a silencer using prior art reflective mufflers with two different size inlet and outlet pipes.
Figure 7B:
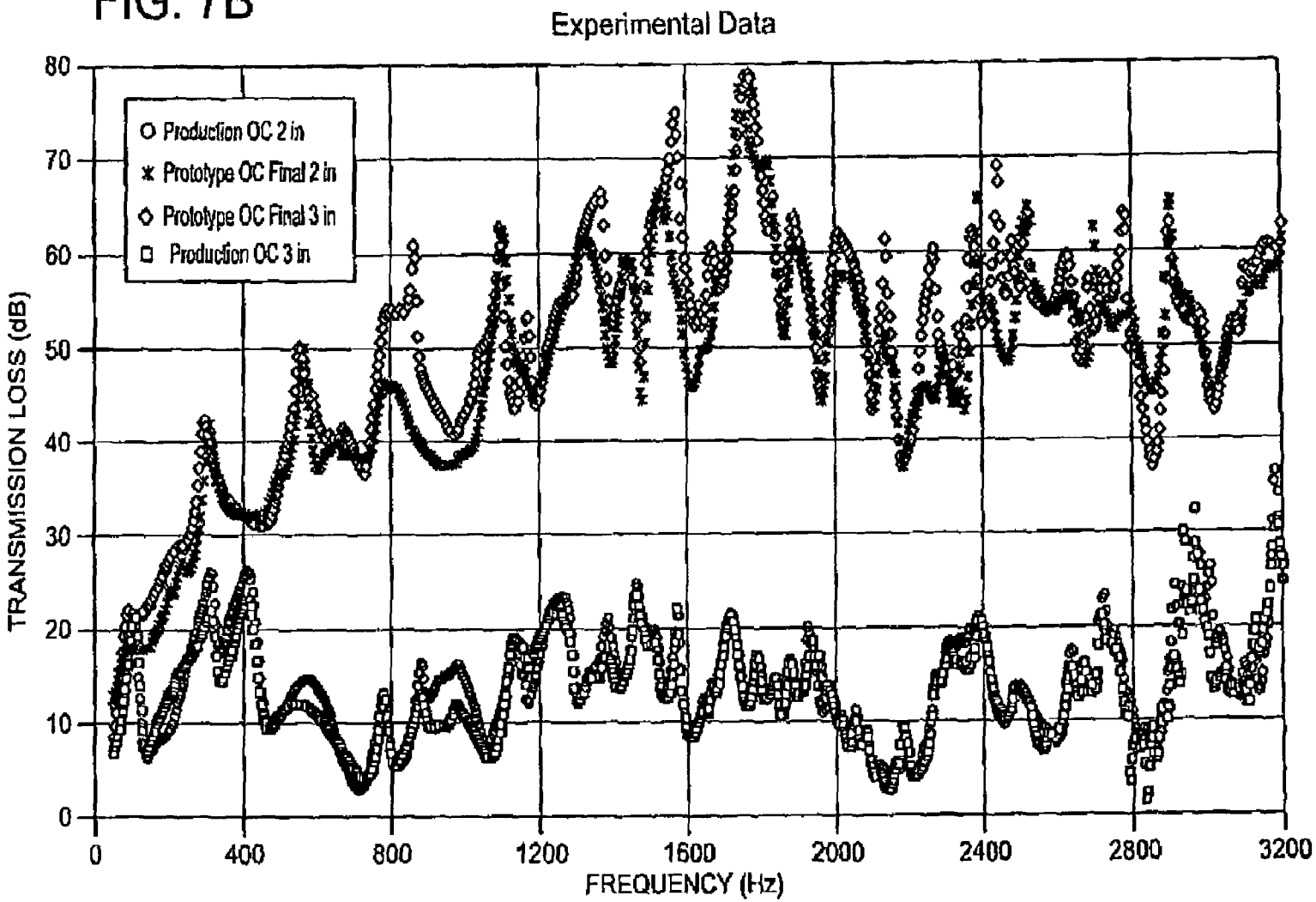
FIG. 7B is a graph of Transmission Loss (y) with no air flow verses Frequency (x) of experimental data generated for 4 prototypes of silencers according to embodiments of the present invention and a silencer using prior art reflective mufflers with two different size inlet and outlet pipes.

FIGS. 7A and 7B illustrate transmission loss vs. frequency curves for each of the two test runs. The first test run is designated "Prototype OC Final 2 in." The second test run is designated "Prototype OC Final 3 in."

Also illustrated in FIGS. 7A and 7B are two plots corresponding to a conventional three-pass reflective production muffler, i.e., the muffler did not include fibrous material of any type, and had the same outer dimensions as the prototype mufflers. The production muffler included a three inch perforated pipe extending through it. During a first test run, designated "Production OC 2 in" as shown in FIGS. 7A and 7B, the input and output pipes of the test equipment were two inches in diameter. Two-inch to three-inch transition sections were provided between the input and output pipes of the test apparatus and the inlet and outlet ends of the perforated pipe. During a second test run, designated "Production OC 3 in" in FIGS. 7A and 7B, the input and output pipes of the test equipment had a diameter of about 3 inches.

As is apparent from FIGS. 7A and 7B, the test run for "Prototype OC Final 2 in" had a peak attenuation frequency at about 92 Hz, where the transmission loss was about 20 dB. At frequencies from about 92 Hz to about 150 Hz, the transmission loss curve decreased slightly, no more than about 3 dB. After about 175 Hz, the transmission loss curve remained above about 20 dB. The test run for "Prototype OC Final 3 in" had a peak attenuation frequency at about 96 Hz, where the transmission loss was about 22 dB. At frequencies from about 92 Hz to about 112 Hz, the transmission loss curve decreased slightly, no more than about 2 dB. After about 140 Hz, the transmission loss curve remained above about 22 dB. In contrast, both runs of the conventional production muffler resulted in transmission loss curves having a narrow range of frequencies below about 200 Hz where transmission losses exceeded 15 dB.

EXAMPLE III

A silencer was constructed as shown in FIGS. 5 and 5A having the following dimensions: L1=12 cm; L2=45 cm; L3=3 cm, the perforations created a porosity of about 30% in the third portion 606 of the pipe 600; L4=17.8 cm; L5=22.9 cm; L6=1.9 cm; L7=5.04 cm; D1=5.08 cm; D2=8.9 cm. The oval cavity 510*a* was filled at a fill density of about 125 grams/liter with fibrous material 512*a* comprising texturized glass filaments, which are commercially available low boron, high temperature from Owens Corning under the product designation ADVANTEX® 162A.

Test apparatus (not shown) was provided which included a source of sound energy, an input pipe coupled to an inlet of the pipe 600 and an output pipe coupled to the outlet of the pipe 600. Microphones were provided at the input and output pipes for sensing sound pressure levels at those locations for frequencies from about 20 Hz to about 3200 Hz. Sound transmission losses at each frequency were determined from the outputs of those microphones. Experiments were performed with all test elements at ambient temperature.

Figure 8A:
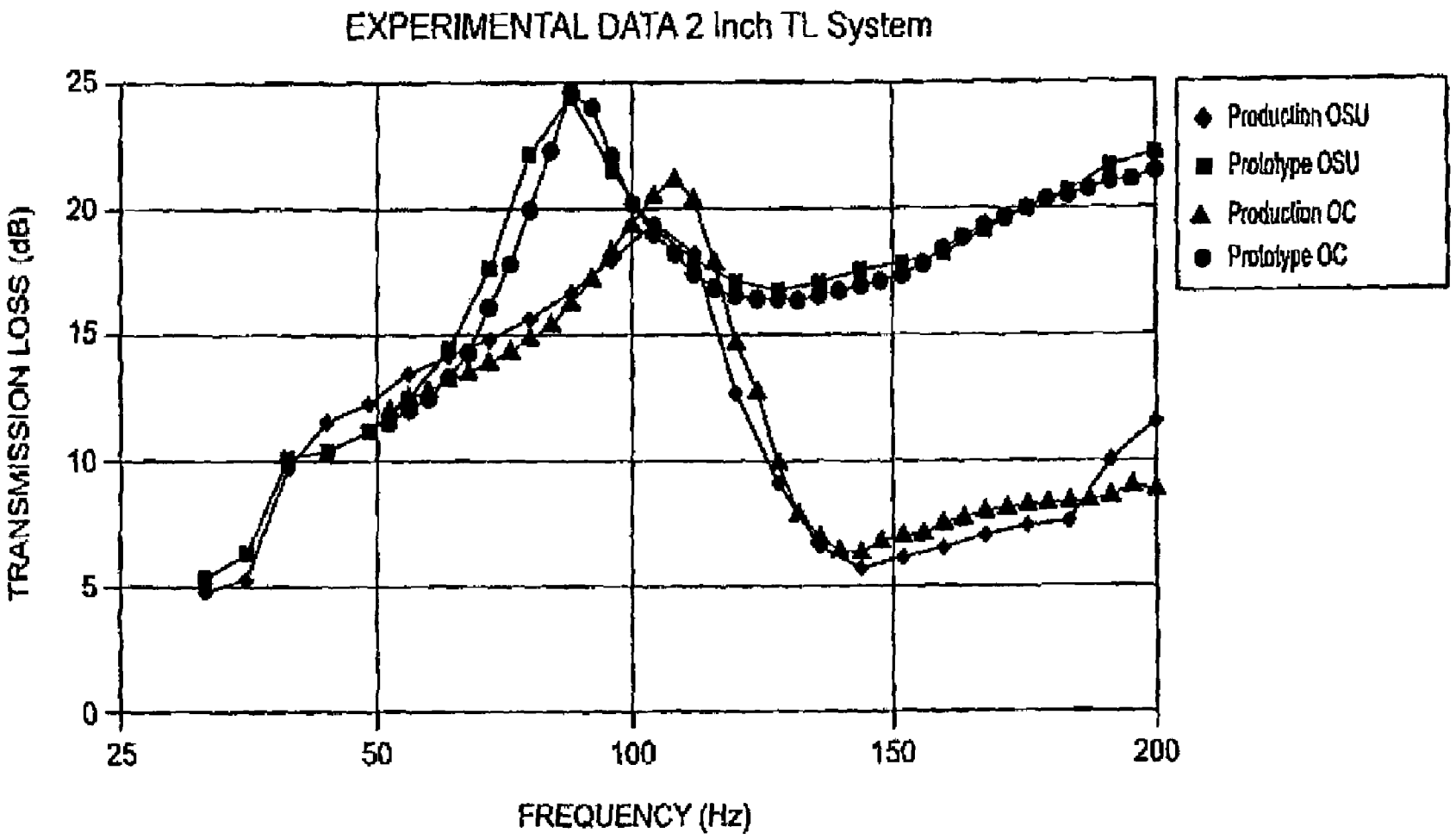
FIG. 8A is a graph of Transmission Loss (y) with no air flow verses Frequency (x) of experimental data generated for 4 muffler embodiments according to the present invention.
Figure 8B:
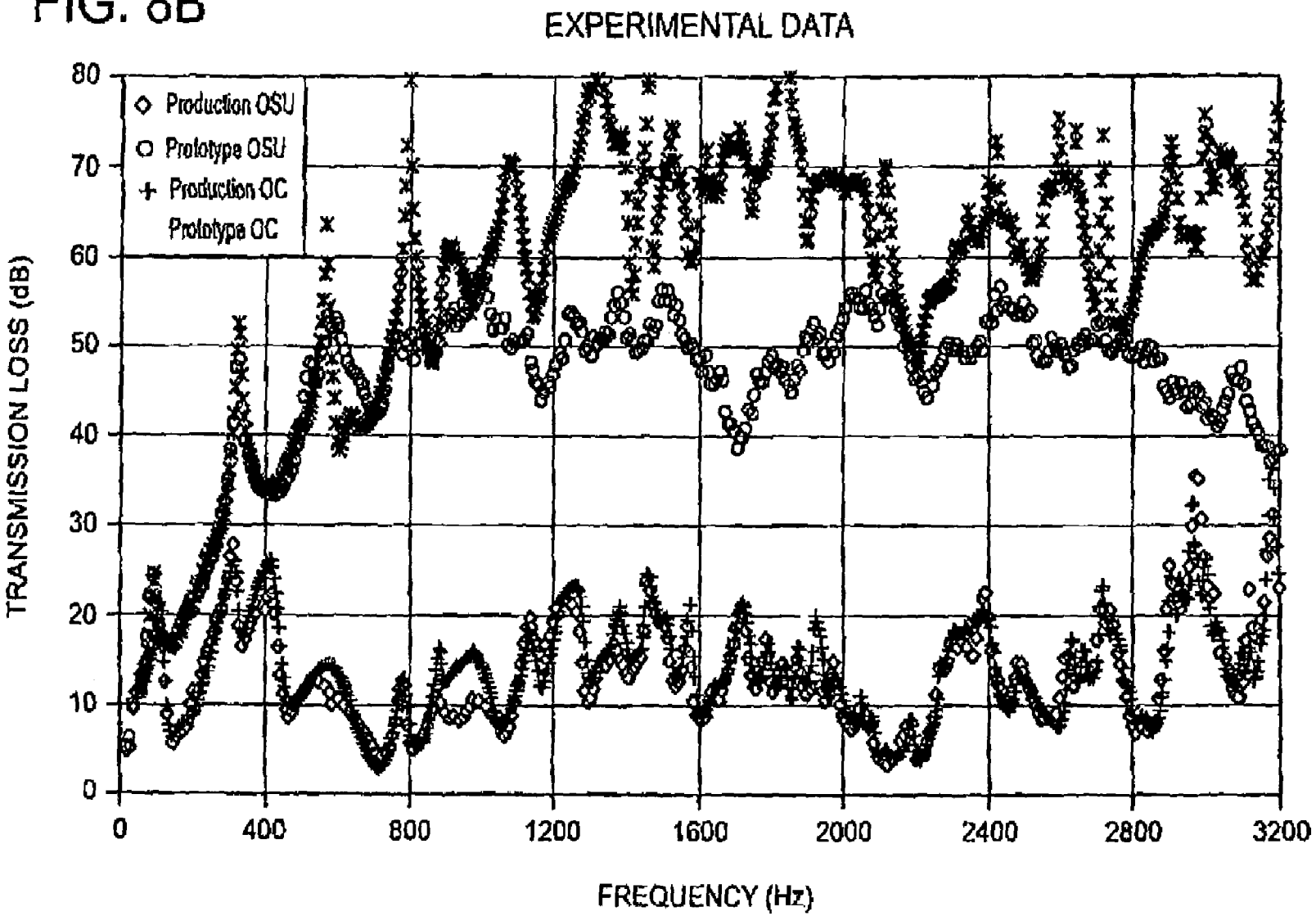
FIG. 8B is a graph of Transmission Loss (y) with no air flow verses Frequency (x) of experimental data generated for 4 muffler embodiments according to the present invention.

FIGS. 8A and 8B illustrate transmission loss vs. frequency curves for each of two test runs using the first silencer. The first test run is designated "Prototype OSU." The second test run is designated "Prototype OC."

During the test runs designated "Prototype OSU" and "Prototype OC" in FIGS. 8A and 8B, the input and output pipes were two inches in diameter, approximately equal to the diameter of the pipe 600.

Also illustrated in FIGS. 8A and 8B are two plots corresponding to a conventional three-pass reflective production muffler. The muffler did not include fibrous material of any type and had the same outer dimensions as the prototype muffler. The muffler included a three inch perforated pipe extending through it. During first and second test runs, the input and output pipes of the test equipment had a diameter of about 2 inches. Hence, two to three-inch transition sections were provided between the input and output pipes of the test apparatus and the inlet and outlet ends of the perforated pipe.

As is apparent from FIGS. 8A and 8B, the test runs for "Prototype OSU" and "Prototype OC" had a peak attenuation frequency of about 88 Hz, where the transmission loss was about 25 Db. At frequencies equal to or greater than about 70 Hz, the transmission losses were equal to or greater than about 15 Db. In contrast, both runs of the conventional production muffler resulted in transmission loss curves having a narrow range of frequencies below about 200 Hz where transmission losses exceeding about 15 Db.

Figure 9:
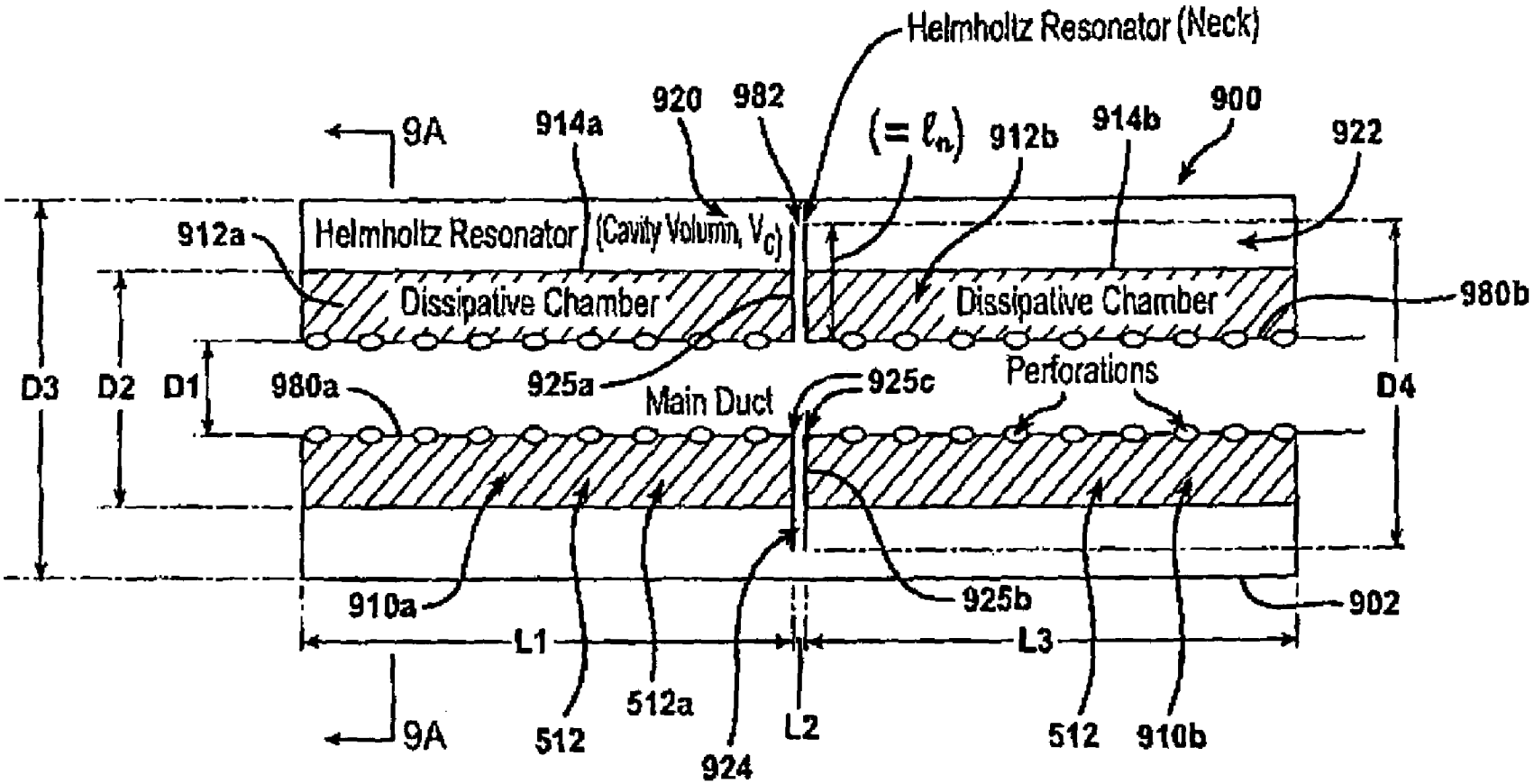
FIG. 9 is a plan view of a silencer according to the present invention.
Figure 9A:
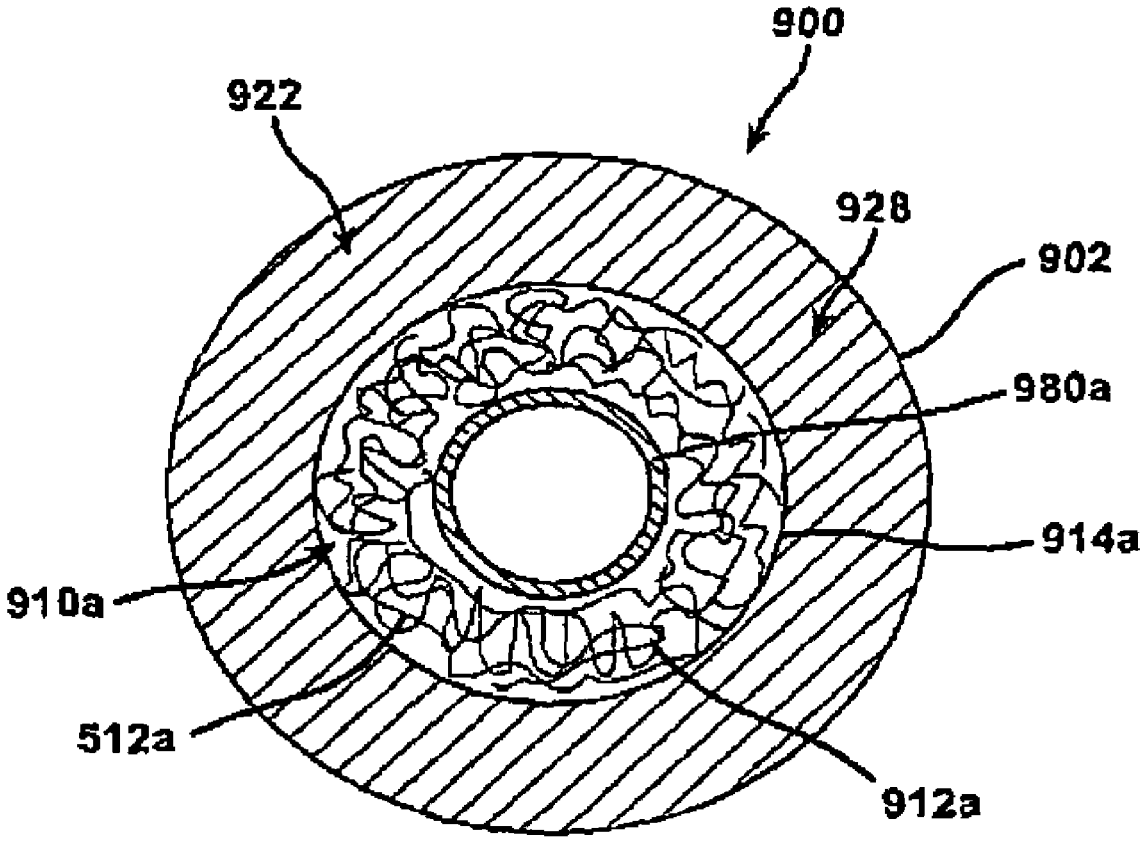
FIG. 9A is a cross-section of FIG. 9 taken along line 9A.

FIG. 9 illustrates in cross section a muffler or silencer 900 constructed in accordance with a third embodiment of the third aspect of the present invention. The silencer 900 comprises a hybrid silencer including first and second dissipative silencer components 910*a* and 910*b* and a reactive element component 920, i.e., a Helmholtz resonator. The silencer 900 does not include a connection component joining the dissipative silencer components 910*a* and 910*b* with the Helmholtz resonator component 920. The dissipative silencer components 910*a* and 910*b* comprises acoustically absorbing material 512, such as fibrous material 512*a*.

The silencer 900 comprises a rigid outer shell 902 formed from a metal, a resin, or a composite material comprising, for example, reinforcement fibers and a resin material. Examples of outer shell composite materials are described in the '972 patent. The outer shell 902, in the illustrated embodiment, has a substantially cylindrical shape. However, the outer shell 902 may have any other geometric shape so long as the requisite volumes for the dissipative silencer components 910*a* and 910*b* and the Helmholtz resonator component 920 to effect the desired attenuation are retained.

Perforated first and second pipes 980*a* and 980*b*, each formed without abrupt bends, are coupled to the outer shell 902 and typically extend part way through the outer shell 902, such that a gap 982 is provided within the shell 902 between the two pipes 980*a* and 980*b*, see FIG. 9. Conventional exhaust pipes, not shown, may be coupled to outer ends of the pipes 980*a* and 980*b* positioned outside of the shell 902. Because the pipes 980*a* and 980*b* are formed without abrupt bends, back pressure and flow losses through the silencer 900 are reduced. The pipes 980*a* and 980*b* are formed having a porosity of between about 5% and 60%.

In the illustrated embodiment, the dissipative silencer components 910*a* and 910*b* each comprise a substantially cylindrical cavity 912*a*, 912*b* defined between an inner, substantially straight, non-perforated pipe 914*a*, 914*b* and one of the pipes 980*a* and 980*b*. Support brackets (not shown) may extend from the pipes 914*a*, 914*b* and be coupled to the outer shell 902. Cavity 912*a* has an outer diameter D2, an inner diameter D1 and a length L1 while cavity 912*b* has an outer diameter D2, an inner diameter D1 and a length L3. Each dissipative silencer component 910*a*, 910*b* may be filled with fibrous material 512*a*, such as described above with regard to the embodiment illustrated in FIGS. 5 and 5A. Further, the pipe 980*a* comprises part of the dissipative silencer component 910*a*, while the pipe 980*b* comprises part of the dissipative silencer component 910*b*.

Disk-shaped end plates 925*a* and 925*b*, each having a first opening 925*c* with a diameter D1 are provided for retaining the fibrous material 512*a* in the cavities 912*a* and 912*b*. The end plates 925*a* and 925*b* may be welded or otherwise coupled to the pipes 980*a*, 980*b*, 914*a*, 914*b*.

The Helmholtz resonator component 920 comprises a cavity portion 922 and a neck portion 924 defined by the gap 982. The cavity 922 has a cylindrical shape in cross section, a length=L1+L2+L3 an outer diameter D3 and an inner diameter D2. The neck portion 924 defines a disk-shape opening having an inner diameter D1, an outer diameter D4 and a length L2. The neck portion 924 is defined by the end plates 925*a* and 925*b*. The neck portion 924 may alternatively have other geometric shapes, such as cones, cylinders and square tubes. Lengthening the neck portion 924 by an extension into the cavity portion 922 helps attain lower resonance frequencies, see equation 7 above. Shortening the length L2 between the dissipative silencer components 910*a* and 910*b* may also help achieve a higher transmission loss at lower frequencies. The effect of geometry including the neck portion location can be accurately predicted by Boundary Element Method.

Figure 10:
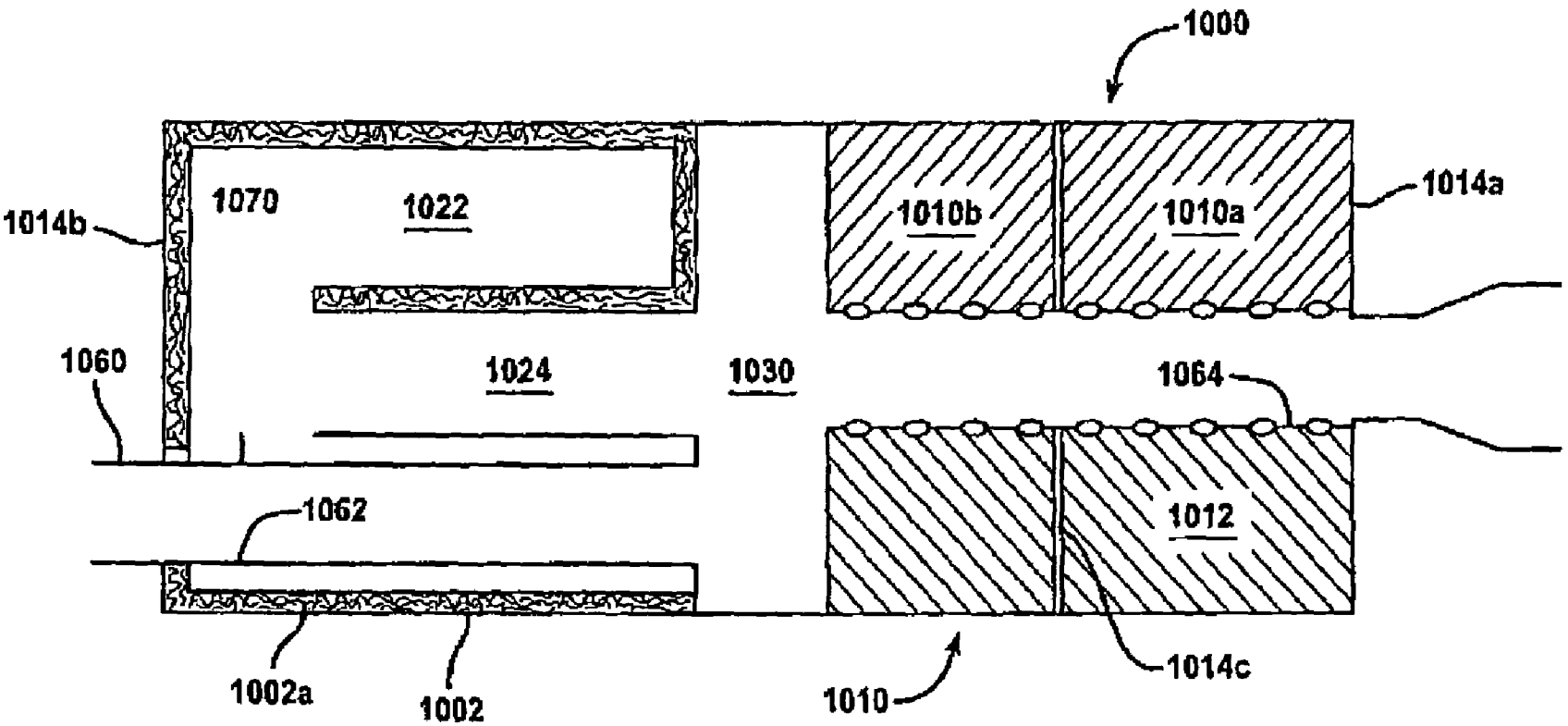
FIG. 10 is a plan view of a silencer including a baffle according to at least one embodiment of the present invention.
Figure 10A:
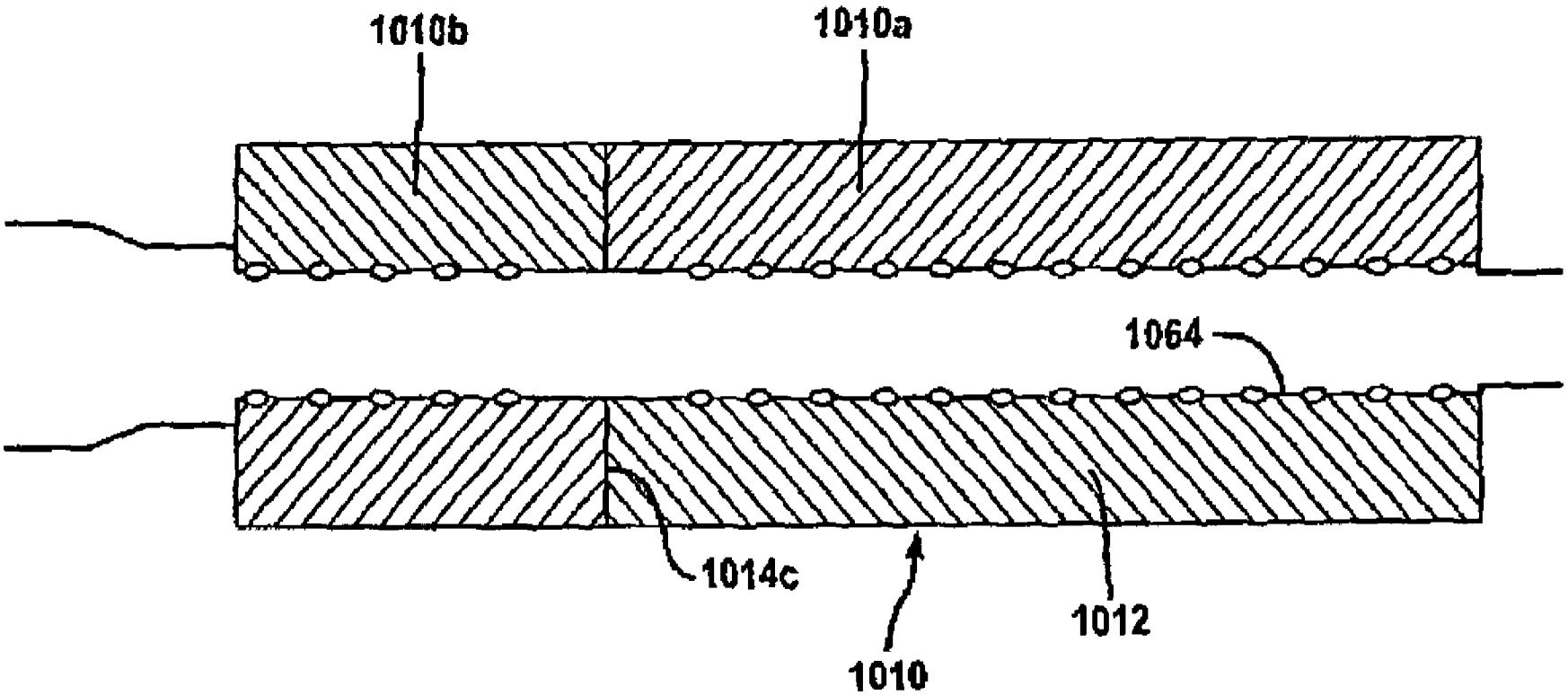
FIG. 10A is a plan view of absorptive muffler including a baffle, useful in the silencer of FIG. 10.

FIG. 10 illustrates, in cross section, a muffler or silencer 1000 constructed in accordance with another embodiment of the present invention. The silencer 1000 comprises a hybrid silencer including a dissipative silencer component 1010 and a reactive element component 1020, i.e., a Helmholtz resonator. The silencer 1000 further includes a connection component 1030 for joining or connecting the dissipative silencer component 1010 with the Helmholtz resonator component 1020. The dissipative silencer component 1010 comprises acoustically absorbing material 1012 and exhibits a desirable broadband noise attenuation at frequencies above about 150 Hz at ambient temperatures. The Helmholtz resonator component 1020 exhibits desirable noise attenuation at low frequencies, e.g., from about 50 to about 120 Hz at room temperature, typical of low-speed internal combustion engine noise as well as low-order airborne noise. Thus, the silencer 1000 is an effective attenuator over a wide range of frequencies. FIG. 10A illustrates and dissipative silencer of the present invention including a baffle 1014*c* in the dissipative component 1010 to separate the component into separate chambers 1010*a* and 1010*b*.

The silencer 1000 comprises a rigid outer shell 1002 formed from a metal, a resin, or a composite material comprising, for example, reinforcement fibers and a resin material. Example outer shell composite materials are set out in the '972 patent. The outer shell 1002, in the illustrated embodiment, has a substantially oval shape. The outer shell 1002 may have any other geometric shape so long as the requisite volumes for the dissipative silencer component 1010 and the Helmholtz resonator component 1020 to effect the desired attenuation are retained.

Pipes, such as substantially straight pipes 1060, 1064, are coupled to the rigid outer shell 1002 and extend through the entire length of the outer shell 1002. The pipe may include pipes having a slight bend or angle, an S-shaped pipe, etc. Conventional exhaust pipes, not shown, may be coupled to outer ends of the pipes 1060, 1064. The pipe 1064 is preferably spaced a sufficient distance away from the inner wall 1002*a* of the outer shell 1002 so as to allow a sufficient amount of fibrous material 1012 to be provided between the pipe 1064 and the shell inner wall 1002*a* to allow for adequate thermal insulation of the outer shell 1002 and to prevent interference by the outer shell 1002 with acoustic attenuation by the dissipative component 1010.

A portion 1062 of pipe 1060, which is not perforated, extends through a cavity 1022 of the Helmholtz resonator component 1020. Pipe 1064 is perforated and forms part of the dissipative silencer component 1010. Between pipe 1060 and 1064 is connection component 1030, which joins dissipative component 1010 and reactive component 1020 with pipe 1062. Pipe 1064 is typically perforated so as to have a porosity, i.e., a percentage of open area to closed area, of between about 5% to about 60%.

The cavity 1022 of the Helmholtz resonator may optionally include a fibrous material 1070 such as glass, mineral or metallic fibers that improve the acoustical properties thereof. Accordingly the silencers of the present invention include a dissipative silencer exhibiting a desirable broadband noise attenuation at frequencies above about 150 Hz at ambient temperature and a resonator component exhibiting desirable noise attenuation at low frequencies, e.g., from about 50 to about 120 Hz at ambient temperature, to form an effective attenuator over a wide range of frequencies.

One skilled in the art will appreciate that the description and drawings form broad teachings which may be implemented in a variety of forms. This invention has been described with reference to particular examples and drawing figures. However the true scope of the invention should not be limited to particular examples and drawing figures since modifications and alterations will be apparent to those in the art after a review of the drawings, specification and claims.

We claim:

1. A silencer for an internal combustion engine comprising:

an outer shell having a body and first and second ends;

an exhaust duct carrying exhaust gasses through said body;

a dissipative silencer positioned within said body and surrounding said exhaust duct;

a Helmholtz resonator comprising a chamber and a throat positioned within said body, wherein said exhaust duct is a perforated exhaust duct and at least one perforation is acoustically coupled to said resonator throat, said throat of said Helmholtz resonator running substantially the length of said dissipative silencer; and a connector component interconnecting said dissipative silencer and said Helmholtz resonator.

2. The silencer of claim 1, wherein at least one perforation is acoustically coupled to said dissipative silencer.

3. The silencer of claim 1, wherein said exhaust duct penetrates the dissipative silencer and the Helmholtz resonator chamber, said exhaust duct having a plurality of perforations along first and second portions of said duct and no perforations along a third portion of said duct, wherein said first portion of the exhaust duct is acoustically coupled to the throat of the Helmholtz resonator, said second portion of the duct is acoustically coupled to the dissipative silencer and said third portion of the duct penetrates the resonator.

4. The silencer of claim 1, wherein the chamber of said resonator includes a porous material.

5. The silencer of claim 4, wherein said porous material is a fibrous material.

6. The silencer of claim 4, wherein said porous material is selected from the group consisting essentially of glass fibers and mineral wool fibers.

7. The silencer of claim 6, wherein said porous material is a high temperature resistant glass fiber.

8. The silencer of claim 1, wherein said dissipative silencer includes at least one baffle within said dissipative silencer.

9. The silencer of claim 8, wherein said at least one baffle separates the dissipative silencer into multiple independent acoustic chambers.

10. The silencer of claim 1, further comprising:

a first end of the silencer; and a second end of the silencer, the chamber of the Helmholtz resonator being positioned at the second end of the silencer wherein the dissipative silencer is positioned between the first and second ends of the silencer, and the throat of the Helmholtz resonator is acoustically coupled to the exhaust duct adjacent the first end of the silencer.

11. The silencer of claim 10, wherein exhaust is input into the silencer at the first end of the silencer.

12. The silencer of claim 10, wherein exhaust is input into the silencer at the second end of the silencer.

13. The silencer of claim 10, wherein the throat has a generally annular cross section.

14. The silencer of claim 10, wherein the throat has a generally circular cross section.

15. The silencer of claim 1 further comprising:

a fibrous fill material within said resonator.

16. The silencer of claim 15 wherein said resonator includes at least one wall and the fibrous fill material lines at least one wall of said resonator.

17. The silencer of claim 1 further comprising:

at least one baffle within said dissipative silencer.

18. A silencer for an internal combustion engine comprising:

an outer shell having a body and first and second ends;

an exhaust duct having a plurality of perforations along a first and a second portion of said duct;

a resonator comprising a chamber and a throat positioned within said body, wherein said throat is acoustically coupled to at least one perforation in said first section of said exhaust duct; and a dissipative silencer positioned within said body and surrounding said second portion of said exhaust duct; wherein said exhaust duct penetrates the dissipative silencer and the resonator chamber, said exhaust duct having a plurality of perforations along a first and second portion of said duct and a third portion of said duct having no perforations, wherein said first section of the duct is acoustically coupled to the throat of the resonator, said second section of the duct is acoustically coupled to the dissipative silencer and said third section of the duct penetrates the resonator; and a connector component interconnecting said dissipative silencer and said resonator;

wherein said throat of said resonator runs substantially the length of said dissipative silencer.

19. The silencer of claim 18, wherein the chamber of the resonator is positioned at a second end of the outer shell, said dissipative silencer being positioned between said first and second ends, and wherein the throat of the resonator is acoustically coupled to the exhaust duct adjacent the first end of the shell.

20. The silencer of claim 19, wherein exhaust is input into the silencer at the first end of the chamber.

21. The silencer of claim 19, wherein exhaust is input into the silencer at the second end of the silencer.

22. The silencer of claim 19, wherein the throat has a generally annular cross section and encompasses the dissipative silencer.

23. The silencer of claim 19, wherein the throat has a generally circular cross section.

24. The silencer of claim 18 further comprising:

a fibrous fill material within said resonator.

25. The silencer of claim 24 wherein said resonator includes at least one wall and the fibrous fill material lines at least one wall of said resonator.

26. The silencer of claim 18 further comprising:

at least one baffle within said dissipative silencer.

27. A silencer comprising:

an outer shell having a body and first and second ends;

a resonator including a chamber and a throat positioned within said body;

a dissipative silencer positioned within said body; and an exhaust duct having a first perforated portion and a second perforated portion, said first and second perforated portions being in fluid communication and separated by said throat of said resonator, said exhaust duct carrying exhaust gasses through said body;

wherein said exhaust duct penetrates the dissipative silencer and extends the length of said resonator chamber and said dissipative silencer; and wherein said first and second portions of said exhaust duct are positioned in a substantially horizontal orientation and centrally located within said outer shell to provide substantially equal amounts of acoustic fill material on opposing sides of said exhaust duct; and wherein said chamber of said resonator is positioned circumferentially around said dissipative chamber.

28. The silencer of claim 27, wherein said first and second perforated portions are substantially equal in length.

29. The silencer of claim 27, the dissipative silencer being positioned between the first and second ends and the throat of the resonator being acoustically coupled to the exhaust duct.

30. The silencer of claim 29, wherein exhaust is input into the silencer at the first end of the outer shell.

31. The silencer of claim 29, wherein exhaust is input into the silencer at the second end of the outer shell.

32. The silencer of claim 29, wherein the throat has a generally annular cross section and encompasses the dissipative silencer.

33. The silencer of claim 29, wherein the throat has a generally circular cross section.

34. The silencer of claim 27 further comprising:

a fibrous fill material within said resonator.

35. The silencer of claim 34 wherein said resonator includes at least one wall and the fibrous fill material lines at least one wall of said resonator.

36. The silencer of claim 27 further comprising:

at least one baffle within said dissipative silencer.

37. A silencer comprising:

an outer shell having first and second ends;

a resonator comprising a chamber and a throat positioned within said outer shell;

a dissipative silencer positioned within said body and including acoustic fill material;

an inlet exhaust duct entering the outer shell through said first end, carrying exhaust gasses through said dissipative silencer, said inlet exhaust duct being centrally located within said outer shell to provide substantially equal amounts of said acoustic fill material on opposing sides of said exhaust duct;

an outlet exhaust duct penetrating said resonator and exiting through said second end, said outlet exhaust duct being offset from said inlet exhaust duct;

an intermediate chamber within said outer shell in fluid communication with said first and second exhaust ducts and said resonator throat; and a baffle within said dissipative silencer separating the silencer into separate acoustical chambers, said acoustic fill material being in both said chambers.

38. The silencer of claim 37 further comprising:

a fibrous fill material within said resonator.

39. The silencer of claim 38 wherein said resonator further comprises:

at least one wall and the fibrous fill material lines at least one wall of said resonator.

40. The silencer of claim 37 further comprising:

a plurality of baffles within said dissipative silencer.

41. A silencer comprising:

an outer shell having first and second ends;

a resonator comprising a chamber and a throat positioned within said outer shell, said resonator including a hollow wall separating said throat from said chamber;

a dissipative silencer positioned within said body;

an inlet exhaust duct entering the outer shell through said first end, carrying exhaust gasses through said dissipative silencer, said first exhaust duct having a plurality of perforations within said dissipative silencer and being aligned with said throat;

an outlet exhaust duct penetrating said resonator and exiting through said second end, said outlet exhaust duct being located adjacent said throat such that said throat is defined between said outlet exhaust duct and said wall;

an intermediate chamber within said outer shell in fluid communication with said inlet and outlet exhaust ducts and said throat of said resonator; and a fibrous fill material within said resonator, said fibrous fill material lining said resonator and filling said hollow wall.

42. The silencer of claim 41 wherein said resonator further comprises:

at least one wall and the fibrous fill material lines at least one wall of said resonator.

43. The silencer of claim 41 further comprising:

a plurality of baffles within said dissipative silencer.

* * * * *